US012655976B1

(12) United States Patent
Ganiger et al.

(10) Patent No.: US 12,655,976 B1
(45) Date of Patent: Jun. 16, 2026

(54) TILED COMBUSTOR LINER FOR GAS TURBINE ENGINES

(71) Applicant: General Electric Company, Evendale, OH (US)

(72) Inventors: Ravindra Shankar Ganiger, Bengaluru (IN); Steven Clayton Vise, Loveland, OH (US); Michael Anthony Benjamin, Cincinnati, OH (US); Sibtosh Pal, Mason, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 19/302,203

(22) Filed: Aug. 18, 2025

(51) Int. Cl.
*F23R 3/00* (2006.01)
*F23R 3/60* (2006.01)

(52) U.S. Cl.
CPC ..... *F23R 3/007* (2013.01); *F23R 3/60* (2013.01); *F23R 2900/00017* (2013.01); *F23R 2900/00019* (2013.01)

(58) Field of Classification Search
CPC .. F23R 3/60; F23R 3/002; F23R 3/007; F23R 2900/00017; F23R 2900/03043; F23R 2900/03044
See application file for complete search history.

(56) References Cited

U.S. PATENT DOCUMENTS 2,576,003 A 11/1951 Dry
2,804,796 A 9/1957 Devine
3,158,059 A 11/1964 Myers
3,159,075 A 12/1964 Bjork
3,266,364 A 8/1966 Becker
4,478,546 A 10/1984 Mercer
4,690,365 A 9/1987 Miller et al.
9,382,875 B2 * 7/2016 Kramer ..... F02C 7/20
10,330,136 B2 6/2019 DiChiara, Jr. et al.
11,781,753 B2 10/2023 Ganiger et al.
2014/0090399 A1 * 4/2014 McAlice ..... F23R 3/60 60/796
2016/0102860 A1 * 4/2016 Chandler ..... B05D 3/12 60/754
2017/0167526 A1 6/2017 Hasegawa
2023/0366554 A1 * 11/2023 Ganiger ..... F23R 3/002
2024/0133556 A1 * 4/2024 Ganiger ..... F02C 7/20
2025/0102147 A1 3/2025 Ohira et al.

FOREIGN PATENT DOCUMENTS

GB 191202937 A 8/1912

* cited by examiner

*Primary Examiner* — Andrew H Nguyen
(74) *Attorney, Agent, or Firm* — Dority & Manning, P.A.

(57) ABSTRACT

A liner for a combustion section of a gas turbine engine includes a sheet defining a sheet opening, a tile liner coupled to the sheet and comprising a plurality of tiles, each tile of the plurality of tiles comprising a protrusion, a fastener for securing each tile of the plurality of tiles to the sheet, the fastener including a bolt including a first half and a second half, the bolt extending between a first end and a second end opposite the first end, the second end of the bolt defining a receptacle between the first half and the second half with the protrusion positioned therein, wherein at least a portion of the first half and the second half of the bolt extend though the sheet opening, and a nut securing the first half of the bolt to the second half of the bolt.

20 Claims, 10 Drawing Sheets

TILED COMBUSTOR LINER FOR GAS TURBINE ENGINES

BACKGROUND

A gas turbine engine typically includes a turbomachine, with a fan in some implementations. The turbomachine generally includes a compressor, combustor, and turbine in serial flow arrangement. The compressor compresses air which is channeled to the combustor where it is mixed with fuel. The mixture is then ignited to generate hot combustion gases. The combustion gases are channeled to the turbine, which extracts energy from the combustion gases for powering the compressor and fan, if used, as well as for producing useful work to propel an aircraft in flight or to power a load, such as an electrical generator.

The combustor includes liners that contain the combustion gases. The liners are designed and built to withstand high-temperature cycles induced during combustion. Conventional liners are formed of metallic material that require significant cooling to be maintained at or below their maximum use temperatures. Accordingly, combustion liners that can withstand high temperatures and allow for thermal expansion are desirable.

BRIEF DESCRIPTION OF THE DRAWINGS

A full and enabling disclosure of the present disclosure, including the best mode thereof, directed to one of ordinary skill in the art, is set forth in the specification, which makes reference to the appended figures.

DETAILED DESCRIPTION

Figure 1:
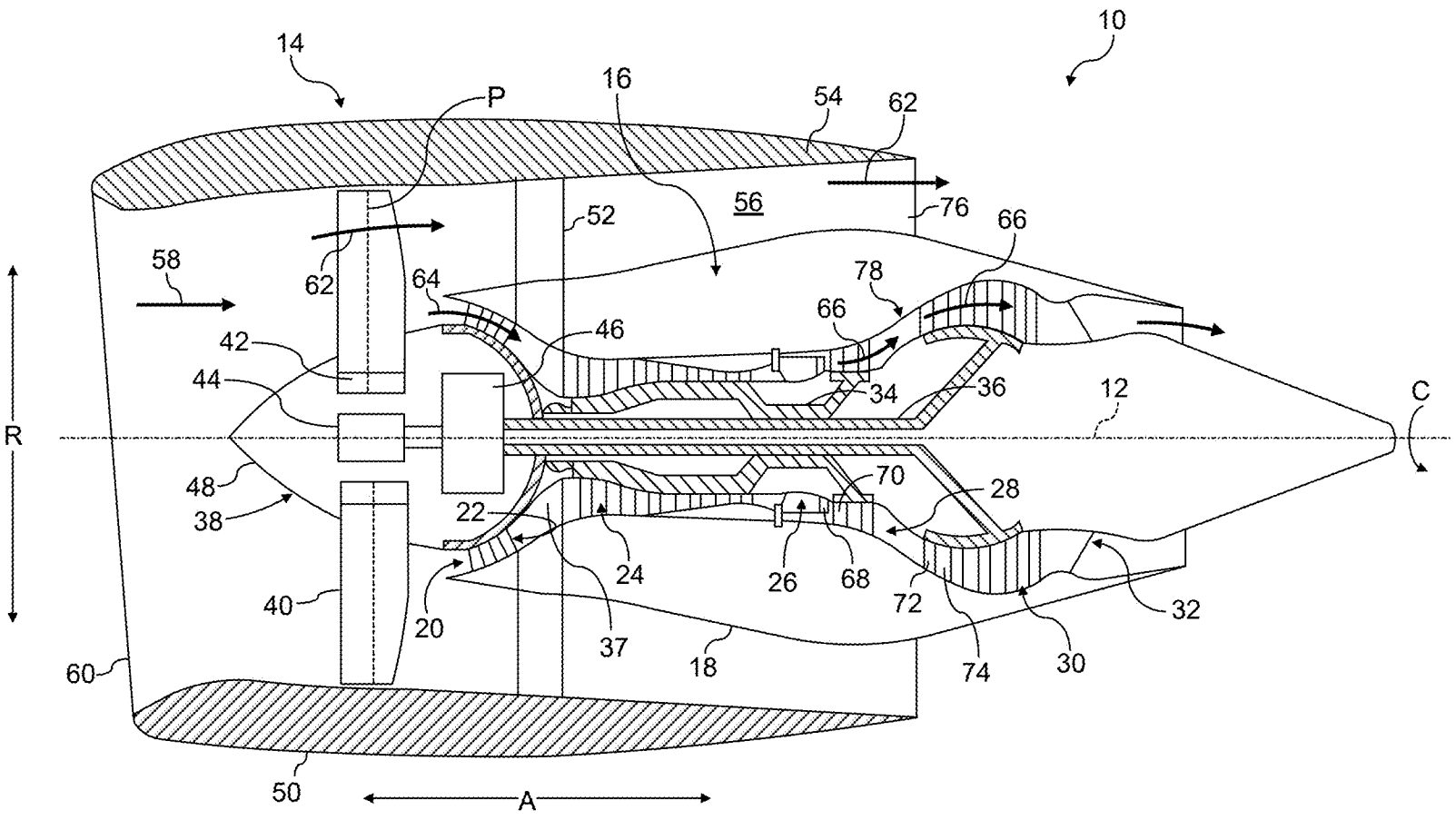
FIG. 1 is a schematic cross-sectional view of a gas turbine engine, in accordance with an exemplary embodiment of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The term "at least one of" in the context of, e.g., "at least one of A, B, or C" refers to only A, only B, only C, or any combination of A, B, and C.

The phrases "from X to Y" and "between X and Y" each refers to a range of values inclusive of the endpoints (i.e., refers to a range of values that includes both X and Y).

The term "turbomachine" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

As used herein, the terms "first", "second", and "third" may be used interchangeably to distinguish one component from another and are not intended to signify location or importance of the individual components.

The present disclosure relates to combustion systems in the field of gas turbine engines. Gas turbine engines include a combustor, which typically includes an inner liner and an outer liner, and conventional combustors use monolithic liners. These liners may experience hoop stresses and durability challenges.

In particular, the present disclosure relates to a combustor having multiple tiles for improved thermal management and stress distribution. Secure attachment of these tiles presents a challenge in high-temperature environments, such as within a combustion chamber of the combustor. Certain combustors may use bulky fasteners or complicated brackets that can increase manufacturing complexity and reduce maintainability. The present disclosure provides a combustor design that accommodates multiple tiles and secures them in a manner that may facilitate mechanical stability. A further objective is to reduce stresses in the liner by distributing load across an assembly that includes a fastener. Another objective is to facilitate removal and replacement of individual tiles or tile retainers as needed.

The present disclosure includes a combustor having an inner liner that uses tiles connected to an outer liner through a fastener. The fastener may extend through an opening in an outer liner, an opening in a wall of the retainer, and a slot in the support wall of the retainer. The fastener may attach or detach the tile for tile maintenance.

The present disclosure addresses challenges found in combustor liners by including a tile assembly retained by a specialized fastener. This approach may improve maintenance efficiency and reduce thermal stresses. Such features to address the challenges include optional tile removal, flexible fastener configurations, and material versatility.

Referring now to the drawings, FIG. 1 is a schematic cross-sectional view of a gas turbine engine 10 in accordance with an exemplary embodiment of the present disclosure. More particularly, for the embodiment of FIG. 1, the gas turbine engine 10 is a high-bypass turbofan jet engine, sometimes also referred to as a "turbofan engine." As shown in FIG. 1, the gas turbine engine 10 defines an axial direction A (extending parallel to a longitudinal centerline 12 provided for reference), a radial direction R, and a circumferential direction C extending about the longitudinal centerline 12. In general, the gas turbine engine 10 includes a fan section 14 and a turbomachine 16 disposed downstream from the fan section 14.

The exemplary turbomachine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft 34 (which may additionally or alternatively be a spool) drivingly connects the HP turbine 28 to the HP compressor 24. A low pressure (LP) shaft 36 (which may additionally or alternatively be a spool) drivingly connects the LP turbine 30 to the LP compressor 22. The compressor section, combustion section 26, turbine section, and jet exhaust nozzle section 32 together define a working gas flowpath 37.

For the embodiment depicted, the fan section 14 includes a fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable pitch change mechanism 44 configured to collectively vary the pitch of the fan blades 40, e.g., in unison. The gas turbine engine 10 further includes a power gear box 46, and the fan blades 40, disk 42, and pitch change mechanism 44 are together rotatable about the longitudinal centerline 12 by LP shaft 36 across the power gear box 46. The power gear box 46 includes a plurality of gears for adjusting a rotational speed of the fan 38 relative to a rotational speed of the LP shaft 36, such that the fan 38 may rotate at a more efficient fan speed.

Referring still to the exemplary embodiment of FIG. 1, the disk 42 is covered by rotatable front hub 48 of the fan section 14 (sometimes also referred to as a "spinner"). The front hub 48 aerodynamically contoured to promote an airflow through the plurality of fan blades 40.

Additionally, the exemplary fan section 14 includes an annular fan casing or outer nacelle 50 that circumferentially surrounds the fan 38 and/or at least a portion of the turbomachine 16. It should be appreciated that the outer nacelle 50 is supported relative to the turbomachine 16 by a plurality of circumferentially-spaced outlet guide vanes 52 in the embodiment depicted. Moreover, a downstream section 54 of the outer nacelle 50 extends over an outer portion of the turbomachine 16 so as to define a bypass airflow passage 56 therebetween.

During operation of the gas turbine engine 10, a volume of air 58 enters the gas turbine engine 10 through an associated inlet 60 of the outer nacelle 50 and fan section 14. As the volume of air 58 passes across the fan blades 40, a first portion of air 62 is directed or routed into the bypass airflow passage 56 and a second portion of air 64 as indicated by an arrow is directed or routed into the working gas flowpath 37, or more specifically into the LP compressor 22. The ratio between the first portion of air 62 and the second portion of air 64 is commonly known as a bypass ratio. A pressure of the second portion of air 64 is then increased as it is routed through the HP compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft 36 to rotate, thereby supporting operation of the LP compressor 22 and/or rotation of the fan 38.

The combustion gases 66 are subsequently routed through the jet exhaust nozzle section 32 of the turbomachine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the gas turbine engine 10, also providing propulsive thrust. The HP turbine 28, the LP turbine 30, and the jet exhaust nozzle section 32 at least partially define a hot gas path 78 for routing the combustion gases 66 through the turbomachine 16.

It should be appreciated, however, that the exemplary gas turbine engine 10 depicted in FIG. 1 is by way of example only, and that in other exemplary embodiments, the gas turbine engine 10 may have any other suitable configuration. For example, although the gas turbine engine 10 depicted is configured as a ducted gas turbine engine (i.e., including the outer nacelle 50), in other embodiments, the gas turbine engine 10 may be an unducted gas turbine engine (such that the fan 38 is an unducted fan, and the outlet guide vanes 52 are cantilevered from the outer casing 18). Additionally, or alternatively, although the gas turbine engine 10 depicted is configured as a geared gas turbine engine (i.e., including the power gear box 46) and a variable pitch gas turbine engine (i.e., including a fan 38 configured as a variable pitch fan), in other embodiments, the gas turbine engine 10 may additionally or alternatively be configured as a direct drive gas turbine engine (such that the LP shaft 36 rotates at the same speed as the fan 38), as a fixed pitch gas turbine engine (such that the fan 38 includes fan blades 40 that are not rotatable about a pitch axis P), or both. It should also be appreciated, that in still other exemplary embodiments, aspects of the present disclosure may be incorporated into any other suitable gas turbine engine. For example, in other exemplary embodiments, aspects of the present disclosure may (as appropriate) be incorporated into, e.g., a turboprop gas turbine engine, a turboshaft gas turbine engine, or a turbojet gas turbine engine.

Figure 2A:
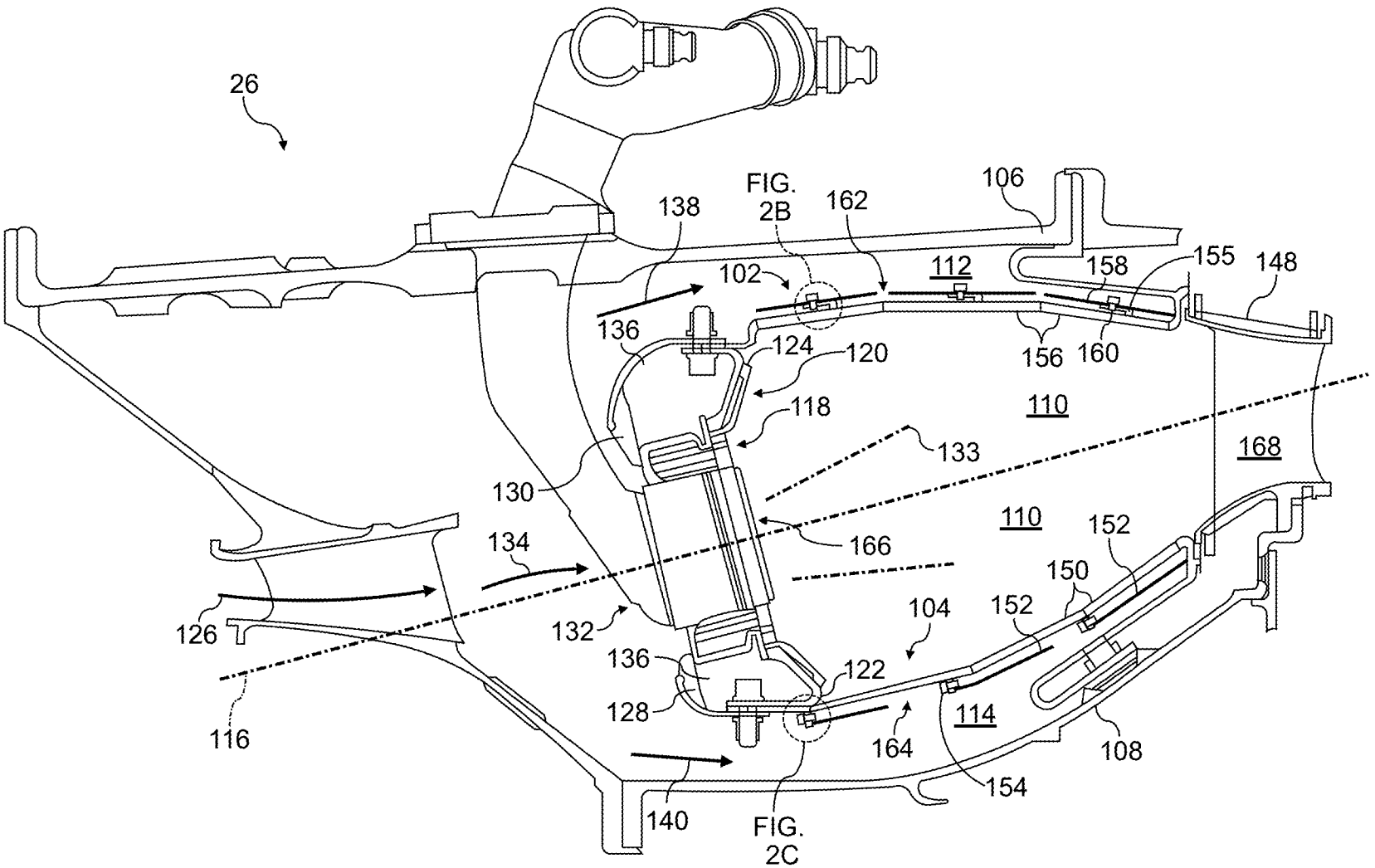
FIG. 2A is a cross-sectional view of a combustion section of the gas turbine engine of FIG. 1, in accordance with an exemplary embodiment of the present disclosure.
Figure 2B:
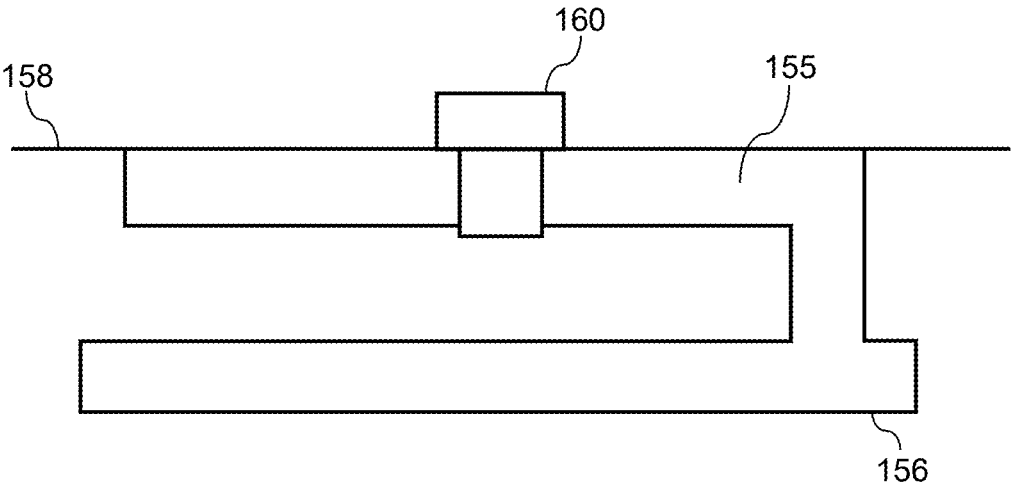
FIG. 2B is a magnified view of a portion of the combustion section of FIG. 2A.
Figure 2C:
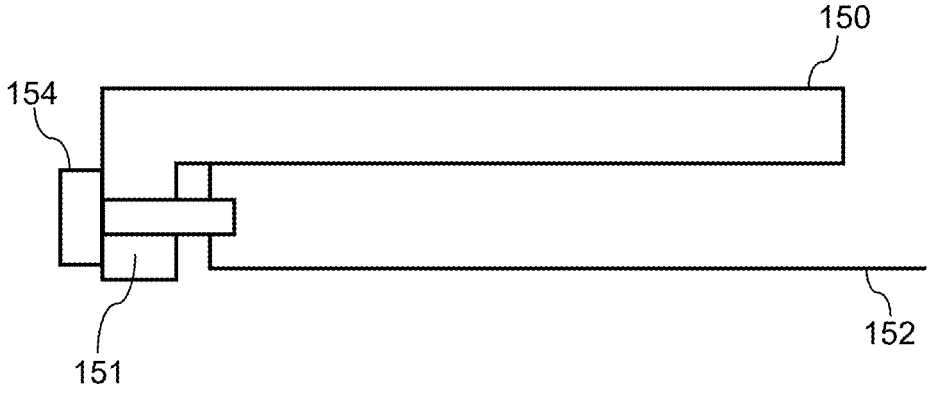
FIG. 2C is a magnified view of a portion of the combustion section of FIG. 2A.

Referring now to FIGS. 2A-2C, schematic cross-sectional views of one exemplary embodiment of the combustion section 26 suitable for use within the gas turbine engine 10 described above is generally provided. FIG. 2A is an entire schematic view. FIG. 2B is magnified view of an outer liner. FIG. 2C is a magnified view of an inner line.

In the exemplary embodiment, the combustion section 26 includes an annular combustor. Exemplary embodiments may define a rich burn or lean burn combustion section 26. Additionally, or alternatively, one skilled in the art will appreciate that the combustor may be any other combustor, including, but not limited to, a single or double annular combustor, a can-combustor, or a can-annular combustor.

As shown in FIG. 2A, the combustion section 26 includes an outer liner 102 and an inner liner 104 disposed between an outer combustor casing 106 and an inner combustor casing 108. The outer liner 102 includes a plurality of outer tile liners 156 and a plurality of outer sheets 158 connected to the outer tile liners 156 with fasteners 160. The inner liner 104 includes a plurality of inner tile liners 150 and a plurality of inner sheets 152 connected to the inner tile liners 150 with fasteners 154. The fasteners 160 connect the outer sheets 158 to a flange 155 of the outer tile liners 156 in a radial direction, as shown in FIG. 2B. The fasteners 154 connect the inner sheets 152 to a flange 151 of the inner tile liners 150 in an axial direction, as shown in FIG. 2C. It will be appreciated that the fasteners 154, 160 may be arranged in either the axial or radial direction to connect the tile liners 150, 156 to the sheets 152, 158.

The plurality of inner tile liners 150 may collectively define portion of a combustion chamber 110. Specifically, the plurality of inner tile liners 150 may collectively define a radially inner flow boundary for the combustion gases flowing through the combustion chamber 110. Similarly, the plurality of outer tile liners 156 may collectively define a portion of the combustion chamber 110. Specifically, the plurality of outer tile liners 156 may collectively define a radially outer flow boundary for the combustion gases flowing through the combustion chamber 110. In other words, the plurality of outer tile liners 156 and the plurality of inner tile liners 150 may be spaced radially from each other such that the combustion chamber 110 is defined therebetween.

In this way, the plurality of outer tile liners 156 and the plurality of inner tile liners 150 may contain and convey combustion gases through the combustion chamber 110 to the turbine section of the gas turbine engine. During operation, the plurality of outer tile liners 156 and the plurality of inner tile liners 150 may be directly exposed to combustion gases and therefore capable of withstanding high thermal stresses. By utilizing the tile liners 150, 156, hoop stresses experienced by prior designs may be reduced or entirely eliminated. Additionally, the combustion section 26 may be easily maintained and serviced because the individualized tile liners 150, 156 may be removed for repair or replacement as necessary.

In many embodiments, the outer liner 102 and outer combustor casing 106 form an outer passage 112 therebetween, and inner liner 104 and inner combustor casing 108 form an inner passage 114 therebetween. The outer sheets 158 may define outer apertures 162, which may guide and direct a flow of cooling air onto the plurality of outer tile liners 156. Similarly, the inner sheets 152 may define inner apertures 164, which may guide and direct a flow of cooling air onto the plurality of inner tile liners 150. The combustion section defines a centerline 116 between the outer liner 102 and the inner liner 104.

The combustion section 26 also includes a combustor assembly 118 comprising an annular dome 120 mounted upstream of the combustion chamber 110 that is configured to be coupled to the forward ends of the outer and inner liners 102, 104. More particularly, the combustor assembly 118 includes an annular inner dome 122 attached to the forward end of the inner liner 104 and an annular outer dome 124 attached to the forward end of the outer liner 102. As shown in FIG. 2, the combustion section 26 may be configured to receive an annular stream of pressurized compressor discharge air 126 from a discharge outlet of the HP compressor 24. To assist in directing the compressed air, the annular dome 120 may further comprise an inner cowl 128 and an outer cowl 130 which may be coupled to the upstream ends of inner and outer liners 104 and 102, respectively. In this regard, an annular opening 132 formed between inner cowl 128 and outer cowl 130 enables compressed fluid to flow through a diffuse opening in a direction generally indicated by arrow 134. The compressed air may enter into a first cavity 136 defined at least in part by the annular dome 120. A portion of the compressed air in the first cavity 136 may be used for combustion, while another portion may be used for cooling the combustion section 26.

In addition to directing air into first cavity 136 and the combustion chamber 110, the inner and outer cowls 128, 130 may direct a portion of the compressed air around the outside of the combustion chamber 110 to facilitate cooling the outer liner 102 and the inner liner 104. For example, as shown in FIG. 2A, a portion of the compressor discharge air 126 may flow around the combustion chamber 110, as indicated by arrows 138 and 140, to provide cooling air to outer passage 112 and inner passage 114, respectively. The air may then flow through the apertures 162, 164 to cool the plurality of tile liners 156, 150.

In certain exemplary embodiments, the inner dome 122 may be formed integrally as a single annular component, and similarly, the outer dome 124 may also be formed integrally as a single annular component. It should be appreciated, however, that in other exemplary embodiments, the inner dome 122 and/or the outer dome 124 may alternatively be formed by one or more components joined in any suitable manner. For example, with reference to the outer dome 124, in certain exemplary embodiments, the outer cowl 130 may be formed separately from the outer dome 124 and attached to the forward end of the outer dome 124 using, e.g., a welding process, a mechanical fastener, a bonding process or adhesive, or a composite layup process. Additionally, or alternatively, the inner dome 122 may have a similar configuration.

The combustor assembly 118 further includes a fuel injector for providing fuel to the combustion chamber 110. More specifically, the fuel is introduced into the combustion chamber 110 by a fuel nozzle assembly or a fuel nozzle 166. The fuel nozzle 166 extends at least partially into the combustion chamber 110 and is configured to provide the fuel, such as a liquid and/or gaseous fuel, to the combustion chamber 110. Fuel and pressurized air are swirled and mixed together, and the resulting fuel/air mixture is discharged into the combustion chamber 110, which combust and generate combustion gases 133.

The combustion section 26 may further comprise an ignition assembly (e.g., one or more igniters extending through the outer liner 102) suitable for igniting the fuel-air mixture. However, details of the fuel injectors and ignition assembly are omitted in FIG. 2 for clarity. Upon ignition, the resulting combustion gases 133 may flow in a generally axial direction through the combustion chamber 110 into and through the turbine section of the gas turbine engine 10 where a portion of thermal and/or kinetic energy from the combustion gases 133 is extracted via sequential stages of turbine stator vanes and turbine rotor blades. More specifically, the combustion gases 133 may flow into an annular, first stage turbine nozzle 148. As is generally understood, the first stage turbine nozzle 148 may be defined by an annular flow channel that includes a plurality of radially-extending, circularly-spaced nozzle vanes 168 that turn the gases so that they flow angularly and impinge upon the first stage turbine blades (not shown) of the HP turbine 28 (FIG. 1).

Figure 3:
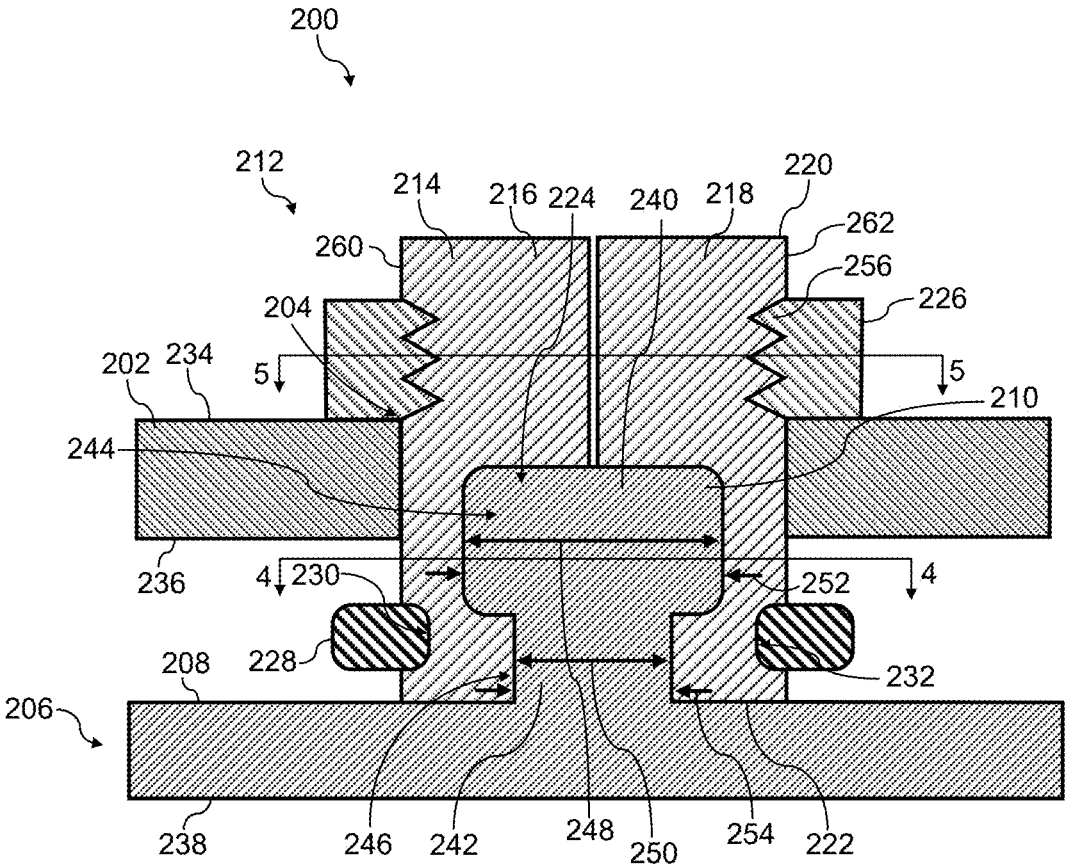
FIG. 3 is a magnified view of the combustion section including a fastener securing a tile to a liner, in accordance with an exemplary embodiment of the present disclosure.

Referring now to FIG. 3, a magnified schematic view of a portion 200 of a combustion section is provided in accordance with another exemplary aspect of the present disclosure. The exemplary portion 200 of FIG. 3 may be configured in substantially the same manner as the exemplary combustion section described above, and accordingly, the same or similar numbers may refer to the same or similar parts. For example, the portion 200 of FIG. 3 generally includes a sheet 202 and a tile liner 206 disposed in an adjacent relationship, with a fastener 212 securing a tile 208 to the sheet 202. The sheet 202 is one of the inner sheets 152 or the outer sheets 158 described above. The tile 208 is part of an exemplary one of the tile liners 150, 156 described above and includes a protrusion 210. The fastener 212 is an exemplary one of the fasteners 154, 160 described above. For the embodiment of FIG. 3, the fastener 212 includes a bolt 214 and a retaining ring 228 disposed about an end of the bolt 214.

The sheet 202 includes a sheet opening 204 that extends through the sheet 202 in a generally axial direction (such as the axial direction A of FIG. 1) and a generally radial direction (such as the radial direction R of FIG. 1). A first side 234 of the sheet 202 is depicted adjacent to a first environment (e.g., passage), while a second side 236 of the sheet 202 is depicted adjacent to the tile liner 206. In various embodiments, the sheet 202 is metal and may have any suitable thickness, for example, ranging from 1 mm to 10 mm. The tile liner 206 is shown disposed on the second side 236 of the sheet 202 and includes a tile 208. The tile 208 may be formed from a ceramic matrix composite or other suitable material. In certain embodiments, the tile 208 may take the form of one of a plurality of tiles 208, each attached to the sheet 202 as described.

The tile 208 includes a protrusion 210 projecting from a base 238 of the tile 208. The protrusion 210 includes a head 240 and a shaft 242. The shaft 242 extends from the base 238 to the head 240. The head 240 is arranged to be wider than the shaft 242, defining a head width 248 that is greater than a shaft width 250, as indicated by the arrows marked in FIG. 3. The head 240 and shaft 242 may each include a substantially cylindrical or other suitable cross-sectional geometry, and the protrusion 210 may be integrally molded or otherwise attached to the tile 208.

The fastener 212 may be used to secure the tile 208 to the sheet 202. In the embodiment of FIG. 3, the fastener 212 includes the bolt 214, which itself includes a first half 216 and a second half 218. The bolt 214 extends from a first end 220 to a second end 222 opposite the first end 220. The first half 216 and second half 218 of the bolt 214 meet together adjacent the protrusion 210. At the second end 222, the bolt 214 defines a receptacle 224 located between the first half 216 and second half 218. The protrusion 210 is positioned within the receptacle 224 so that the protrusion 210 is secured between the two halves 216, 218 of the bolt 214.

The fastener 212 further includes a nut 226, which is engaged with the first end 220 of the bolt 214. In some embodiments, the nut 226 may be a single-piece, unitary construction and may engage threads 256 located on the outside of the first end 220. In the illustrated embodiment, the threads 256 are provided to facilitate retention of the nut 226 on the first end 220. The fastener 212 may optionally include a gap 258 between the first half 216 and the second half 218, the presence of which may improve thermal compliance.

The retaining ring 228 is disposed about the bolt 214 at the second end 222. In the embodiment shown, the retaining ring 228 is positioned adjacent to the receptacle 224 and secures the first half 216 and second half 218 of the bolt relative to each other. The retaining ring 228 may be located closer to the second end 222 of the bolt 214 than to the first end 220. In one example, the retaining ring 228 is seated within a first retaining ring slot 230 defined on the first half 216 and a second retaining ring slot 232 defined on the second half 218. This arrangement restricts axial movement of the two halves 216, 218 of the bolt 214 relative to each other. The retaining ring 228 may extend fully around the circumference of the receptacle 224 or may occupy only a part of the circumference depending on system operation.

The tile 208 defines geometries to accommodate the protrusion 210 as well as the interaction with the bolt 214. The base 238 of the tile 208 transitions outward to present the protrusion 210, with the shaft 242 extending generally normal to the plane of the tile 208 and terminating at the head 240. In practice, the receptacle 224 of the bolt 214 includes a head cavity 244 and a shaft cavity 246. The head cavity 244 has a head cavity width 252 based on the head width 248 of the head 240, and the shaft cavity 246 has a shaft cavity width 254 based on the shaft width 250 of the shaft 242 such that the head cavity 244 is wider than the shaft cavity 246.

On the opposing sides of the receptacle 224, the head cavity 244 and shaft cavity 246 provide a snug fit around the corresponding portions of the protrusion 210. This configuration allows the protrusion 210 to move slightly axially, radially, or circumferentially during thermal expansion without significant constraint from the fastener 212, which may improve the durability of both the tile 208 and the fastener 212 during operation.

The arrangement of the nut 226, the bolt 214, and the retaining ring 228 is such that the nut 226 is positioned on the first side 234 of the sheet 202, while the retaining ring 228 is positioned on the second side 236. The arrangement shown in FIG. 3 illustrates the configuration where the sheet opening 204 accommodates at least a portion of both the first half 216 and the second half 218 of the bolt 214, enabling extension through the sheet opening 204.

In operation, as the tile 208 and protrusion 210 undergo thermal expansion, the fastener 212 may flex or displace to accommodate this expansion. The design of the receptacle 224 with its segmented cavities (described below) and the optional gap 258 between the two halves of the bolt 214 allows for this relative movement. The interaction between the head 240 and the head cavity 244 and between the shaft 242 and the shaft cavity 246 further supports this movement.

It should be understood that the tile 208 may be a part of a tile liner 206 including a plurality of tiles 208, each configured similarly with similar protrusions 210 and secured by corresponding fasteners 212 as shown in FIG. 3. In alternative embodiments, the head 240 and shaft 242 may be formed with different cross-sectional shapes, such as rectangular, elliptical, or polygonal, and the dimensions of the receptacle 224 may be tailored for the specific tile configuration.

The illustrated arrangement of FIG. 3 also provides flexibility regarding the assembly and disassembly of the tile 208 from the sheet 202. For example, the nut 226 and retaining ring 228 may be removed or adjusted to facilitate replacement of the bolt 214 or the tile 208. This construction also may be used with different liner or tile materials as needed. As an example, the embodiment shown in FIG. 3 can be used where the fastener 212 is formed from metallic materials and tiles 208 are formed from ceramic matrix composite (CMC) or other heat-resistant materials. This combination may improve the ability of the joint to withstand the differential thermal expansion between the metal and the CMC.

Alternative embodiments may omit the retaining ring 228 or substitute different fastening mechanisms at the second end 222, such as a second nut or alternative locking device. In some instances, the receptacle 224 may be continuous between the bolt halves, and the slots 230, 232 for the retaining ring 228 may be omitted or repositioned.

In the embodiment shown, the sheet 202 is a monolithic, metallic structure, and the tile 208 is disposed entirely on the hot side, adjacent to the combustion chamber environment. This arrangement may improve maintainability and may simplify inspection and replacement of the tiles.

The configuration of the fastener 212 illustrated in FIG. 3 allows for the nut 226 to engage with both the first half 216 and the second half 218 of the bolt 214 simultaneously. In some examples, the first half 216 defines a first bolt outer surface 260, and the second half 218 defines a second bolt outer surface 262, and the nut 226 extends around both bolt outer surfaces 260, 262. This may provide improved retention forces under different thermal load conditions.

It should be appreciated that the dimensions and arrangements of the head 240, shaft 242, head cavity 244, shaft cavity 246, and related reference widths (248, 250) shown in FIG. 3 are for illustration, and may be varied as appropriate for specific engine requirements. For instance, the head width 248 may be 10-50% greater than the shaft width 250, depending on the desired expansion and load transfer characteristics.

Still further, the fastener 212 of FIG. 3 may include additional or alternative components to accommodate unique attachment schemes. As one example, the gap 258 between the first half 216 and second half 218 of the bolt 214 may be filled with a compliant or semi-rigid element if further vibration damping is desired.

Overall, the embodiment of FIG. 3 provides detailed structural support for the secure attachment of a tile 208 to a sheet 202 in a gas turbine combustor, facilitating optional tile replacement, improved thermal accommodation, and flexible fastener retention arrangements.

Figure 4:
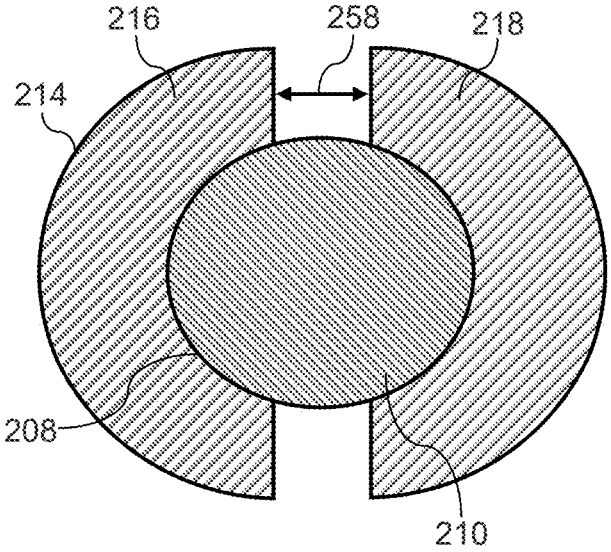
FIG. 4 is a cross-sectional view of a bolt of the fastener and a protrusion of the tile along the line 4-4 of FIG. 3, in accordance with an exemplary embodiment of the present disclosure.

Referring now to FIG. 4, a schematic cross-sectional view of the bolt 214 and the protrusion 210 of the tile 208 of FIG. 3, taken along line 4-4 of FIG. 3, is provided. The exemplary arrangement of FIG. 4 may be configured in substantially the same manner as the exemplary structure depicted in FIG. 3, and accordingly, the same or similar numbers may refer to the same or similar parts. For example, the exemplary arrangement of FIG. 4 generally includes the bolt 214 having the first half 216 and the second half 218, configured to retain the protrusion 210 extending from the tile 208. However, for the embodiment of FIG. 4, the relationship between the first half 216 and the second half 218 of the bolt 214 is further illustrated, including the presence of the gap 258 disposed therebetween.

As depicted in FIG. 4, the bolt 214 includes two distinct sections, namely, the first half 216 and the second half 218. The first half 216 and the second half 218 are positioned such that they are spaced apart by the gap 258. This configuration is beneficial for accommodating thermal expansion and mechanical compliance during operation of the combustor. The gap 258 is defined by an offset distance between the facing surfaces of the first half 216 and the second half 218, as shown by the double-headed arrow. For example, during thermal loading, the gap 258 may permit the first half 216 and the second half 218 to move slightly relative to one another, which may improve the structural integrity of the assembly.

The tile 208 of FIG. 4 includes the protrusion 210 that extends into the receptacle 224 (FIG. 3) defined cooperatively by the first half 216 and the second half 218 of the bolt 214. The circumferential interface between the protrusion 210 and the bolt 214 is shown in cross-section, illustrating how the first half 216 and the second half 218 of the bolt 214 cooperate to surround and retain the protrusion 210 from the tile 208. The protrusion 210 may take the form of a generally cylindrical or other geometric extension from the tile 208, with the bolt 214 providing direct mechanical retention.

In the embodiment shown, the gap 258 is present between the adjacent edges of the first half 216 and the second half 218. This optional feature permits the bolt 214 to respond flexibly to changes in temperature, pressure, or mechanical loading during engine operation. For instance, if required by engine design constraints, the gap 258 may be varied in dimension, or in some alternative embodiments may be omitted altogether. The use of the gap 258 may also be advantageous when the fastener 212 and the protrusion 210 (and thus the tile 208) are formed from materials with differing coefficients of thermal expansion.

In an example arrangement, the bolt 214 may be fabricated from a metallic material, while the protrusion 210 may be formed from a ceramic matrix composite (CMC). The gap 258 can thus provide compliance to compensate for differences in expansion rates between the metal and CMC components. Furthermore, in other embodiments, the gap 258 may be filled with a compliant or semi-rigid insert, such as a high-temperature elastomer or metallic spring component, to moderate movement and absorb vibration if required by the application.

The positioning of the first half 216 and the second half 218 of the bolt 214 about the protrusion 210 is such that each half contacts the protrusion 210 from opposing sides, offering mechanical stability. The circumferential encirclement of the protrusion 210 provides a beneficial load distribution, reducing the likelihood of concentrated stresses on the protrusion 210 during operation. In this manner, the fastener 212 retains the protrusion 210 securely while accommodating relative movement.

It will be understood that, although shown as two equally sized halves in FIG. 4, the first half 216 and second half 218 of the bolt 214 may be configured with varying relative thicknesses or geometries to accommodate specific mechanical or manufacturability requirements. In certain embodiments, the edges defining the gap 258 may be beveled, radiused, or otherwise configured to facilitate guided movement.

The cross-sectional depiction of FIG. 4 illustrates one possible relationship between the fastener and the protrusion. In other examples, the cross-sectional profile of the protrusion 210 may be non-circular. For instance, a polygonal or elliptical shaft could be used to achieve particular engagement or anti-rotation features, and the corresponding cavities in the first half 216 and second half 218 of the bolt 214 may be tailored accordingly.

The split nature of the fastener 212, highlighted by the gap 258 between the first half 216 and the second half 218 of the bolt 214, may also be configured to allow for relative rotation, axial displacement, or torsional flexibility, depending on operational requirements. The assembly shown in FIG. 4 supports straightforward assembly and disassembly, as either half of the bolt 214 may be removed or replaced individually if needed.

In practice, some embodiments may use this gap 258 to insert temporary retention features during assembly or service, such as alignment pins or spacers, further supporting ease of maintenance. In still other embodiments, the features demonstrated in FIG. 4 may be used in combination with additional fastener elements, such as biasing springs or retaining rings, which may be located at other positions along the bolt 214.

For instance, while the embodiment in FIG. 4 focuses on the relationship between the first half 216, the second half 218, and the protrusion 210, other optional components such as a nut, a retaining ring, or a biasing member may be employed elsewhere in the assembly, as shown in other figures described herein. The gap 258 remains optional and is not necessary in all implementations, allowing manufacturers to adapt the design to a variety of engine and combustor configurations.

Figure 5:
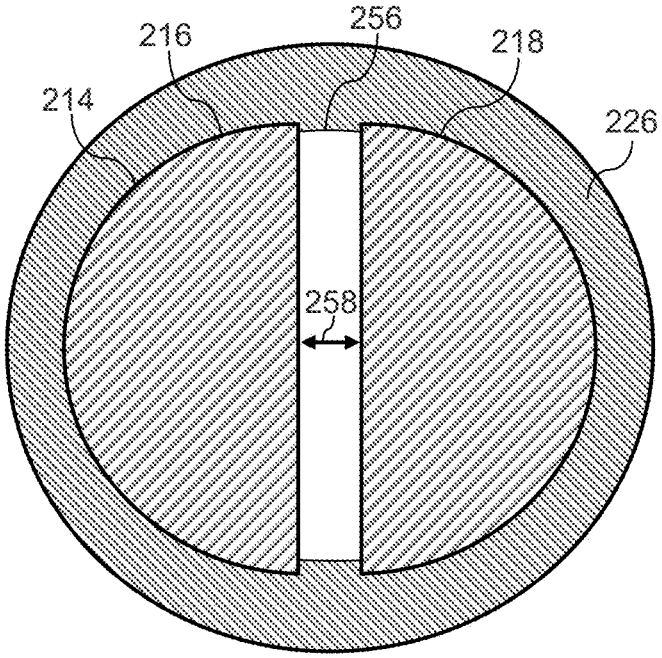
FIG. 5 is a cross-sectional view of a nut of the fastener and the bolt along the line 5-5 of FIG. 3, in accordance with an exemplary embodiment of the present disclosure.

Referring now to FIG. 5, a schematic cross-sectional view of the bolt 214 and the nut 226 taken along line 5-5 of FIG. 3 is provided. The exemplary structure of FIG. 5 may be configured in substantially the same manner as the exemplary fastener structure of FIGS. 3 and 4, and accordingly, the same or similar numbers may refer to the same or similar parts. For example, the exemplary arrangement of FIG. 5 generally includes the bolt 214 positioned within the nut 226, where the bolt 214 itself includes the first half 216 and the second half 218 forming a split bolt configuration. However, for the embodiment of FIG. 5, the cross-sectional view is taken at the region of the nut 226 to illustrate the engagement between the bolt 214 and the nut 226.

In the embodiment of FIG. 5, the bolt 214 is shown to include two separate portions, namely, the first half 216 and the second half 218, spaced from each other to form a gap 258. The nut 226 is arranged to surround both the first half 216 and the second half 218 of the bolt 214. This split configuration of the bolt 214 is arranged such that the nut 226 is able to simultaneously engage both the first half 216 and the second half 218 of the bolt 214. The arrangement may allow the nut 226 to provide a retaining force holding the first half 216 and the second half 218 together, while maintaining the gap 258 between them. For example, the gap 258 between the first half 216 and the second half 218 may improve compliance of the assembly to accommodate mechanical or thermal effects, such as those caused by differential thermal expansion.

The nut 226 shown in FIG. 5 may be a single-piece, unitary construction. In this example, the nut 226 may define an internal surface shaped to engage external surfaces of both the first half 216 and the second half 218, forming a secure threaded engagement. For instance, the nut 226 may be threaded internally, and the bolt 214 may define external threads 256 (FIG. 3), so that the nut 226 may be rotated to move axially along the bolt to draw the halves together.

The geometry illustrated in FIG. 5 also demonstrates that the nut 226 can engage both the first half 216 and second half 218 of the bolt 214 at the same time. For instance, in certain examples, the internal threading of the nut 226 may be continuous and extend across both halves of the bolt. The nut 226, being unitary, avoids the need for multiple piece fasteners or dual-nut arrangements at this portion of the fastener 212. This configuration may simplify service and assembly of the tile 208.

Although depicted in FIG. 5 as a unitary nut 226 engaging a bolt 214, the present disclosure contemplates alternative arrangements. For example, in some alternative embodiments, the nut 226 may consist of two or more sections mating around the bolt halves. In additional examples, different thread profiles, diameters, or fastening mechanisms may be used depending on the type of engine and mechanical loads expected.

The gap 258 between the first half 216 and second half 218 of the bolt 214, as presented in the cross-section of FIG. 5, may also be varied in dimension or even omitted if more rigid retention is desired for a specific application. The presence of the gap 258 contributes to the overall flexibility of the fastening scheme, which may be beneficial for accommodating dimensional changes in high-temperature environments. The nut 226 in this arrangement is not limited to any specific material and may be fabricated from suitable high-temperature alloys or other metals compatible with the intended service environment.

It will be understood that, in the embodiment of FIG. 5, the nut 226 may be positioned at different axial locations along the bolt 214, provided it continues to engage both halves. The cross-sectional relationship supports a variety of bolt geometries, such as semi-circular, polygonal, or other custom shapes, depending on space and load requirements.

Figure 6:
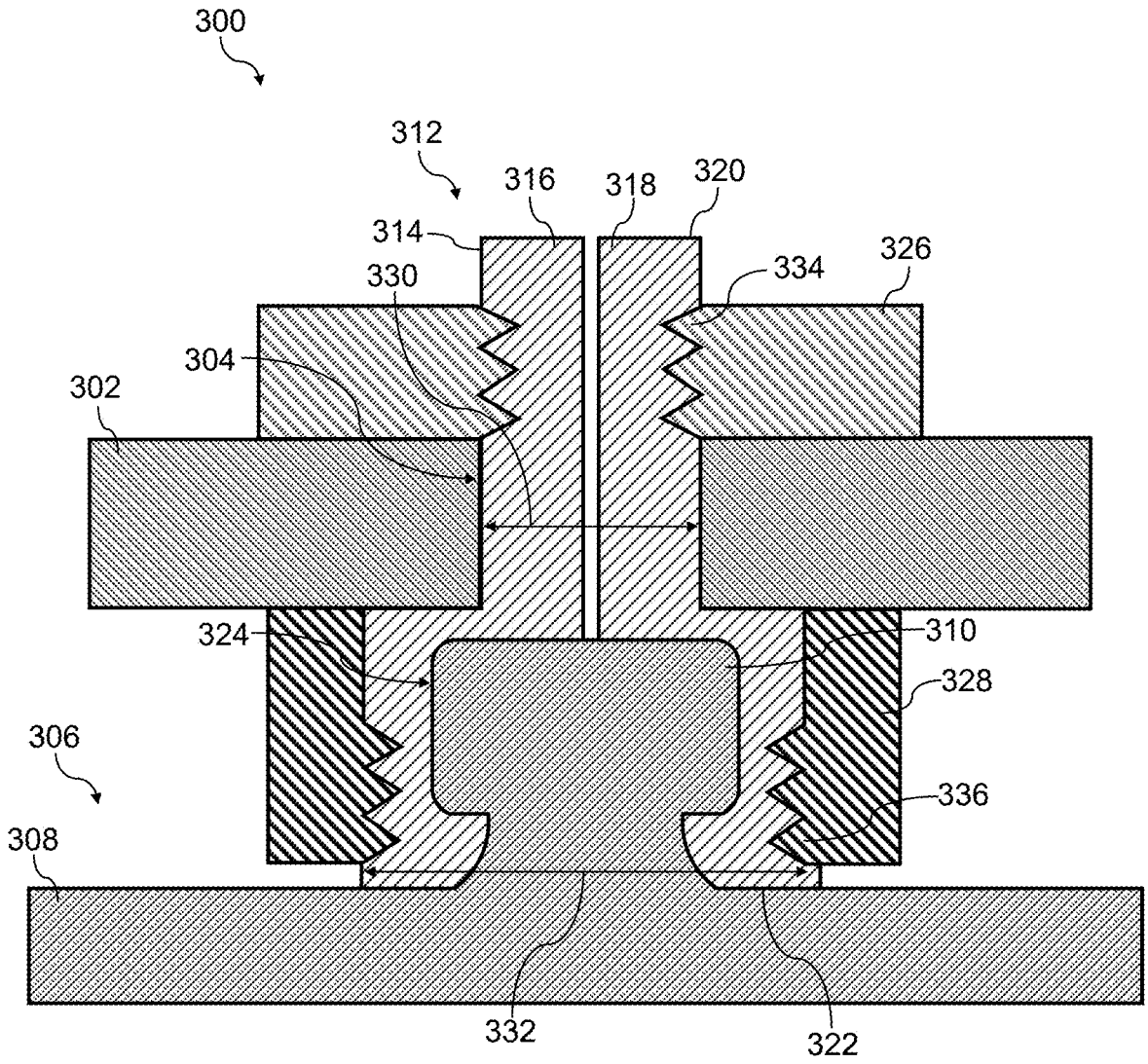
FIG. 6 is a magnified view of the combustion section including another fastener securing a tile to a liner, in accordance with an exemplary embodiment of the present disclosure.

Referring now to FIG. 6, a schematic magnified view of a portion 300 of a combustion section is provided. The portion 300 including a sheet 302, tile liner 306, and a fastener 312 is provided in accordance with another exemplary aspect of the present disclosure. The exemplary portion 300 of FIG. 6 may be configured in substantially the same manner as the exemplary structure of FIGS. 3-5, and accordingly, the same or similar numbers may refer to the same or similar parts. For example, the exemplary portion 300 of FIG. 6 generally includes a sheet 302 defining a sheet opening 304, a tile liner 306 adjacent to the sheet 302, and a plurality of tiles 308 (of which only one is shown) each defining a protrusion 310 secured to the sheet 302 by a fastener 312. However, for the embodiment of FIG. 6, the fastener 312 includes a bolt 314 having a first half 316 and a second half 318 of varying width, as well as a first nut 326 and a second nut 328 located at opposite ends of the bolt 314.

The sheet 302 includes the sheet opening 304. The sheet 302 may be constructed from metal. In this embodiment, the sheet 302 is depicted as a monolithic, metallic component. The sheet opening 304 accepts and supports the fastener 312 extending through the sheet 302 from a first side to a second side. On the second side of the sheet 302, a tile liner 306 is disposed proximate the sheet 302. The tile liner 306 includes a plurality of tiles 308. At least one tile 308 is shown in FIG. 6 and may be formed of a ceramic matrix composite (CMC) or other suitable heat-resistant material. Each tile 308 defines a protrusion 310 extending away from the tile 308 in the direction of the fastener 312.

The fastener 312 secures each tile 308 of the plurality of tiles to the sheet 302. The fastener 312 includes the bolt 314. The bolt 314 includes the first half 316 and the second half 318 that, together, extend from a first end 320 to an opposing second end 322 of the bolt 314. At least a portion of the first half 316 and the second half 318 of the bolt 314 extend through the sheet opening 304, such that the fastener 312 connects both the sheet 302 and the tile liner 306.

The second end 322 of the bolt 314 defines a receptacle 324 between the first half 316 and the second half 318. The protrusion 310 of the tile 308 is positioned within the receptacle 324 for secure engagement. The protrusion 310 may include a head and a shaft (not separately labeled in FIG. 6), as described above in reference to other embodiments, and can be CMC. The bolt 314 may be configured such that the first half 316 and second half 318 can move away from each other in response to thermal expansion of the protrusion 310. This allows for differential expansion between the liner material (which may be metal) and the tile material (which may be CMC), and may improve the likelihood of accommodating stresses arising from such expansion.

The embodiment shown in FIG. 6 depicts the first nut 326 located at the first end 320 of the bolt 314. The first nut 326 is threaded and secured to the outer surface of both the first half 316 and the second half 318 of the bolt 314. In certain instances, the first half 316 and second half 318 define a first bolt outer surface and a second bolt outer surface, respectively, and the first nut 326 may extend around both outer surfaces. The first end 320 of the bolt 314 is disposed on a first side of the sheet 302.

On the opposing second end 322 of the bolt 314, the second nut 328 is engaged with the split bolt 314. The second nut 328 is arranged in a manner similar to the first nut 326, engaging with the exterior of the bolt 314 and securing the two halves 316, 318 at the second end. The second nut 328 may also extend around both bolt halves and provide mechanical retention for the assembly. This optional use of the second nut 328 enables the fastener 312 to be secured from both sides of the sheet 302. In the embodiment of FIG. 6, the first nut 326 and the second nut 328 may be single-piece, unitary constructions.

The first nut 326 may include threads 334, and the second nut 328 may include threads 336 to facilitate engagement and axial positioning of the nuts 326, 328 along the length of the bolt 314. The split nature of the bolt 314 defines a gap (not separately labeled in FIG. 6) between the first half 316 and the second half 318, which may improve compliance and flexibility in response to thermal or mechanical strain. This characteristic can be tailored depending on the required resilience and capacity for relative displacement during operation.

The bolt 314 of FIG. 6 is depicted with varying width at different axial positions. For example, the first end 320 may have a first end width 330, while the second end 322 may have a second end width 332. In some embodiments, the first end width 330 is different than the second end width 332, such that the bolt 314 adapts to different loads or desired engagement with the sheet opening 304, the receptacle 324, or other system interfaces.

The configuration of the bolt 314, first half 316, and second half 318, together with the location of the first nut 326 and the second nut 328, illustrates an example of a fastener that secures the tile 308 to the sheet 302. This arrangement may allow for the first end of the bolt to be disposed on the first side of the liner, and the second end of the bolt to be disposed on the opposing second side of the liner. The split fastener 312 secures the protrusion 310 of the tile 308, for instance by the split halves 316, 318, while the nuts 326, 328 provide axial retention of the bolt and, by extension, of the tile 308 against the sheet 302.

It will be understood that the dimensions and shapes of the first end width 330 and second end width 332 may be varied as desired for different combustor configurations. In this embodiment, the different widths may result from machining or casting operations intended to optimize the stress distribution on the bolt or the interaction with the sheet opening 304 and/or the tile protrusion 310. In certain embodiments, both the first end width 330 and second end width 332 may be the same, and in other embodiments, the widths may differ as depicted.

The depicted assembly permits optional movement of the split bolt halves 316, 318 relative to each other. For instance, if the protrusion 310 (formed of CMC) expands during operation, the first half 316 and second half 318 may move away from each other to reduce the likelihood of generating excessive loads on the protrusion 310. The inclusion of the gap between the first and second halves 316, 318 of the bolt 314 further provides resilience against vibrational or thermal cycling effects.

The tile 308, as part of the tile liner 306, may be installed and maintained using the fastener 312 of FIG. 6. For example, to replace the tile 308, an operator may loosen or remove one or both of the first nut 326 and the second nut 328, allowing removal of the split bolt 314 from the sheet opening 304 and disengagement of the protrusion 310 from the receptacle 324. This configuration may improve the likelihood of facilitating tile replacement, especially in high-temperature environments where material expansion is common.

Alternative embodiments may include other features for retention or optional sealing, such as washers or spacers between the nuts 326, 328 and the sheet 302 or the tile liner 306. The split bolt 314 and the first and second nuts 326, 328 may be constructed from various high-temperature metallic materials as suited for the field of gas turbine engine combustors.

The embodiment of FIG. 6 also supports versatility in the selection of materials for the tiles, protrusions, liner, and fastener components. For instance, the tile 308 may be CMC, while the sheet 302 is metal and the split bolt and nuts are formed from an alloy selected for mechanical strength and oxidation resistance. The configuration shown may be implemented for either inner or outer liners, and further adapted to support any suitable arrangement of tile liners and securing mechanisms.

For example, in an arrangement where the fastener 312 is required to resist axial displacement under high-load conditions, the first end width 330 of the bolt at the first end 320 may be increased relative to the second end width 332 for added retention, or vice versa. The ends may also be configured for specific interaction with the corresponding nuts and liner opening geometries.

The portion 300 including the features described above may be integrated into a gas turbine engine according to the configuration required for the engine's combustion section. While the embodiment of FIG. 6 includes both first and second nuts, alternative embodiments may include only one nut or may utilize additional retention features such as a retaining ring in place of, or in addition to, the second nut.

Figure 7:
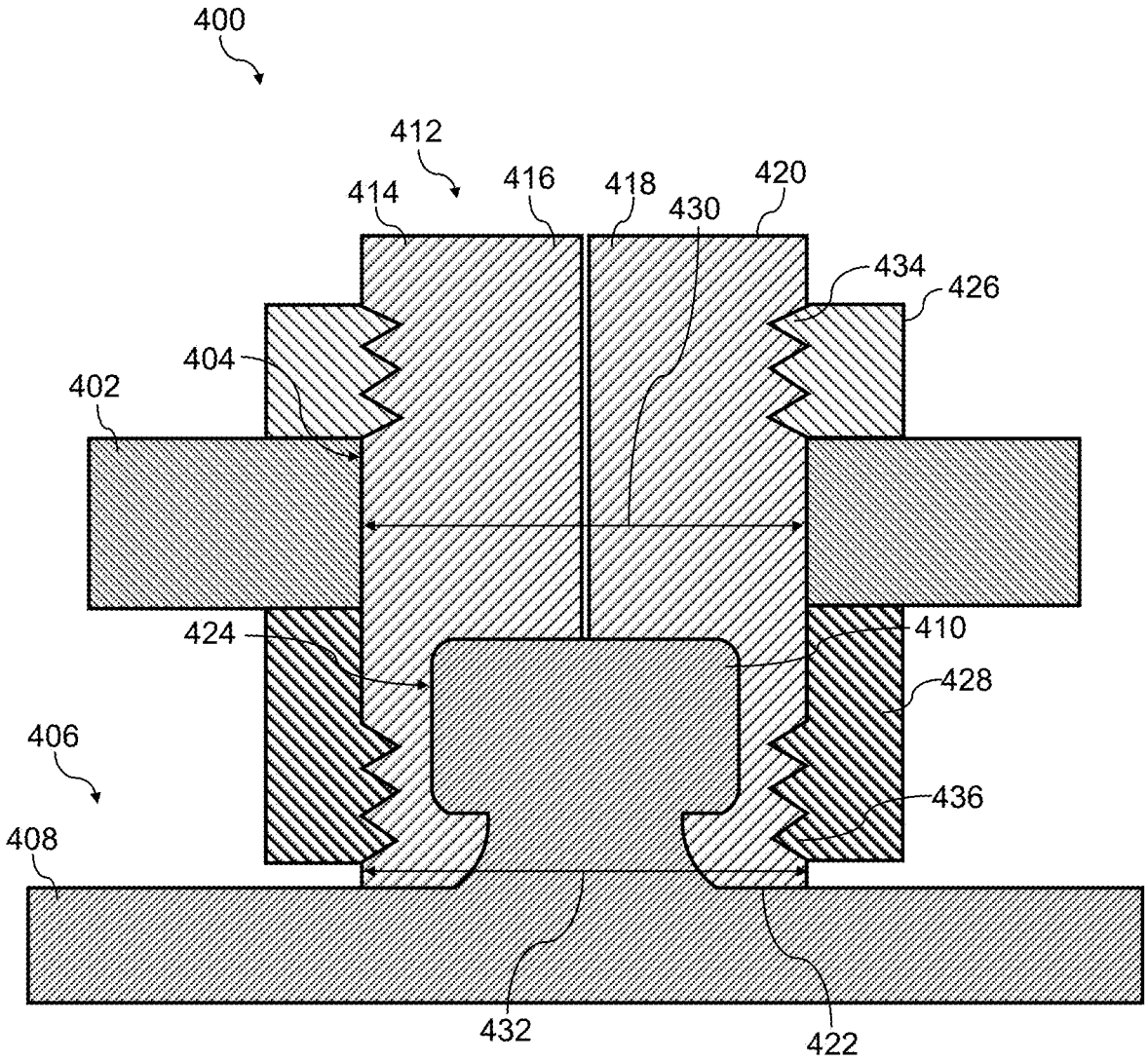
FIG. 7 is a magnified view of the combustion section including another fastener securing a tile to a liner, in accordance with an exemplary embodiment of the present disclosure.

Referring now to FIG. 7, a schematic view of a portion 400 of a combustion section is provided. The exemplary portion 400 of FIG. 7 may be configured in substantially the same manner as the exemplary structures of FIGS. 3 and 6, and accordingly, the same or similar numbers may refer to the same or similar parts. For example, the exemplary portion 400 of FIG. 7 generally includes a sheet 402 defining a sheet opening 404, a tile liner 406 adjacent to the sheet 402, and a fastener 412 arranged to secure a tile 408 to the sheet 402. However, for the embodiment of FIG. 7, the fastener 412 includes a split bolt 414 with a constant width along its axial length, first and second nuts 426, 428 positioned at opposite ends, and a gap between the first half 416 and the second half 418 of the bolt 414. Further, in the embodiment of FIG. 7, the sheet 402 is metallic, the tile 408 may be formed of a ceramic matrix composite (CMC), and the split bolt 414 is structured to move away at the gap upon thermal expansion of the protrusion 410.

The portion 400 includes the sheet 402. The sheet 402 includes a sheet opening 404 extending therethrough. The sheet 402 is metallic in this embodiment and may form part of the inner or outer liner assembly of the portion 400. On one side of the sheet 402, a tile liner 406 is shown, including a tile 408. The tile 408 is optionally formed of a ceramic matrix composite, which is beneficial for operation in high-temperature environments and may accommodate high thermal loading and cyclic expansion.

Each tile 408 includes a protrusion 410 extending away from a base of the tile 408 and projecting towards the fastener 412. The protrusion 410 of the tile 408 is formed of CMC in the embodiment of FIG. 7, but may be formed from any high-temperature tolerant material in alternative embodiments. The protrusion 410 may be configured as one of a plurality of protrusions used to secure a plurality of tiles in the combustor.

The bolt 414 includes a first half 416 and a second half 418. The first half 416 and the second half 418 of the bolt 414 are separated by a gap that extends parallel to the axis of the bolt. The presence of the gap is optional and may beneficially allow the first half 416 and second half 418 to move away from each other during thermal expansion of the protrusion 410, such as when the tile 408 expands under operating temperature. In this embodiment, the gap provides additional compliance to the fastener assembly and may improve the likelihood of accommodating differential thermal growth between the metallic sheet 402 and the CMC protrusion 410.

The fastener 412 engages the sheet 402, tile 408, and protrusion 410 to secure the tile 408 to the sheet 402. The bolt is inserted through the sheet opening 404, and at least a portion of both the first half 416 and the second half 418 extend through the sheet opening 404, in accordance with the system configuration.

The bolt 414 includes a first end 420 and a second end 422. The first end 420 of the bolt 414 is disposed on a first side of the sheet 402, while the second end 422 of the bolt 414 is disposed on an opposing second side of the sheet 402. This arrangement reflects an axial retention configuration, with retention elements provided at both ends 420, 422.

The second end 422 of the bolt 414 defines a receptacle 424, sized to accommodate the protrusion 410. The receptacle 424 in the embodiment of FIG. 7 is defined between the first half 416 and second half 418 and receives the protrusion 410 to achieve a mechanical interlock. In operation, as the protrusion 410 (formed of CMC) undergoes thermal expansion, the first half 416 and second half 418 of the bolt 414 may move away from each other along the gap to accommodate this change, without imposing excessive constraint or localized force on the protrusion 410 or the tile 408.

More particularly, a first nut 426 is engaged with the first end 420 of the bolt 414 with threads 434, securing both halves together on the first side of the sheet 402. A second nut 428 is engaged with the second end 422 of the bolt 414 with threads 436, securing both halves together on the second side of the sheet 402. The first nut 426 and the second nut 428 may each be a single-piece, unitary construction, and both extend around the first half 416 and the second half 418 of the bolt 414, facilitating even retention force across the assembly.

The first end 420 defines a first end width 430, and the second end 422 defines a second end width 432. In the embodiment of FIG. 7, the bolt 414 is shown to be of a constant width along its length, so that the first end width 430 and the second end width 432 are the same width. This arrangement may offer manufacturing, assembly, and stress distribution advantages by providing a uniform engagement interface for the nuts 426, 428 or any additional retention elements. The configuration where the first end width is the same as the second end width is considered optional but may be desirable where even clamping forces or simplified part geometries are sought.

The arrangement described in FIG. 7 may be utilized in instances where all tiles 408 are formed of CMC, and the fastener 412 is metallic. Since CMC and metal have different coefficients of thermal expansion, the gap between the first half 416 and second half 418 allows for each half to move away from the other in response to the thermal growth of the CMC protrusion 410. As a further example, the fastener 412 may alternatively be employed where the sheet 402 is metallic, and the tile 408 and protrusion 410 are another heat-resistant material, with the separation in the bolt 414 adapting to the material expansion characteristics.

Assembly and maintenance of the portion 400 depicted in FIG. 7 may be accomplished by removing one or both nuts 426, 428 and extracting the bolt 414 from the sheet opening 404. This feature may facilitate replacement or inspection of the tile 408 or sheet 402, as needed, without necessitating the removal of surrounding structural elements. For example, in the event of tile damage, the bolt 414 may be withdrawn and the tile 408 removed and replaced individually.

The configuration of the bolt 414 with a constant width, coupled with the optional gap and dual nut retention at both the first end 420 and the second end 422, may provide robustness for a variety of service conditions. Examples may include high-cycle environments, high-temperature applications, and designs where the ability for the fastener 412 to flex or move apart in response to tile expansion is beneficial. In alternate embodiments, additional features such as washers, locking inserts, or compliant members may be included at either end of the bolt 414.

It should be appreciated that, although the embodiment of FIG. 7 depicts a single tile 408 and fastener 412 assembly, multiple such configurations may be employed across the entirety of the tile liner 406. The overall construction is well suited to modular tile designs, and the dimensions, materials, and assembly sequence may be modified to suit the field requirements of various gas turbine engine combustors.

Figure 8:
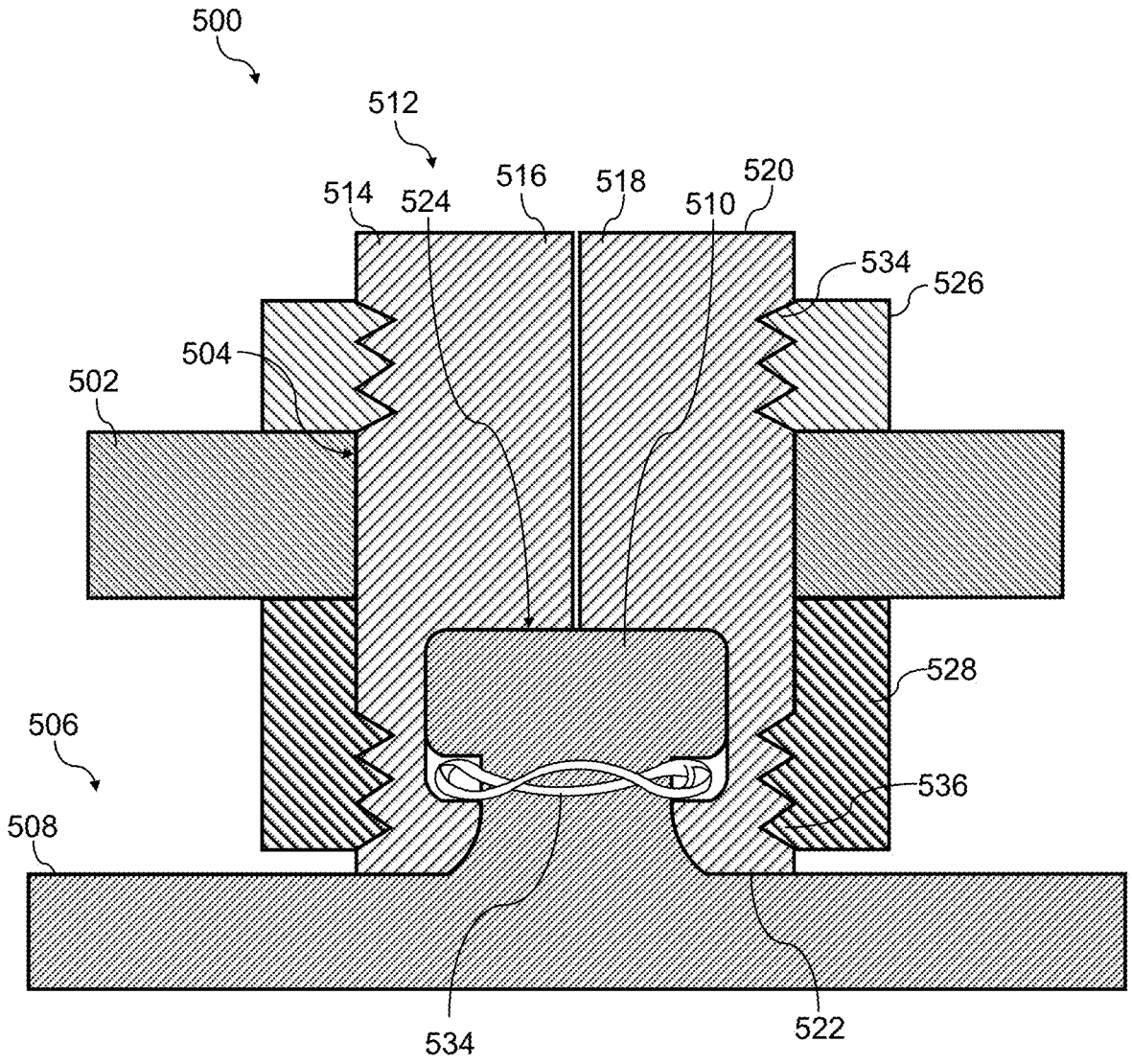
FIG. 8 is a magnified view of the combustion section including another fastener securing a tile to a liner and a biasing member, in accordance with an exemplary embodiment of the present disclosure.

Referring now to FIG. 8, a schematic magnified view of a portion 500 is provided in accordance with another exemplary aspect of the present disclosure. The exemplary portion 500 of FIG. 8 may be configured in substantially the same manner as the exemplary structure of FIGS. 3-7, and accordingly, the same or similar numbers may refer to the same or similar parts. For example, the exemplary portion 500 of FIG. 8 generally includes a sheet 502 defining a sheet opening 504, a tile liner 506 including at least one tile 508, and a fastener 512 securing a protrusion 510 of the tile 508 to the sheet 502. However, for the embodiment of FIG. 8, the portion 500 includes a biasing member 534 disposed adjacent the protrusion 510 and located between the protrusion 510 and the fastener 512. The biasing member 534 is positioned to urge the protrusion 510 outward, away from the sheet 502, thereby providing a force that urges the protrusion 510 against the fastener 512 during thermal expansion of the tile 508 and the fastener 512.

The sheet 502 is a metallic structure defining a sheet opening 504 extending therethrough. The sheet 502 forms a boundary of the combustion section and serves as a structural support for the attachment of the tile liner 506. As shown, the sheet opening 504 provides an aperture allowing the fastener 512 to extend from a first side of the sheet 502 to a second side of the sheet 502.

The tile liner 506 includes at least one tile 508. The tile 508 may be formed from a ceramic matrix composite, although other high-temperature materials may be used. The tile 508 is positioned adjacent to the sheet 502 and includes a protrusion 510 extending from the surface of the tile 508 facing the sheet 502.

The fastener 512 of FIG. 8 includes a bolt 514 having a first half 516 and a second half 518. The bolt 514 extends through the sheet opening 504, such that both the first half 516 and the second half 518 extend from a first end 520 of the bolt 514, through the sheet 502, to a second end 522 of the bolt 514. The second end 522 of the bolt 514 defines a receptacle 524 formed between the first half 516 and the second half 518, wherein the protrusion 510 is positioned. The first half 516 and second half 518 of the bolt 514 may move away from each other in response to thermal expansion of the protrusion 510, as described for other embodiments.

The fastener 512 includes a first nut 526 is engaged with the first end 520 of the bolt 514, securing the first half 516 to the second half 518. The first nut 526 may define internal threads that engage corresponding threads of the bolt 514. In certain embodiments, the first nut 526 is a single-piece, unitary construction and extends around both the first half 516 and second half 518 of the bolt. In some variants, the first nut 526 may be metallic and configured to distribute the load evenly across the fastener 512.

The fastener 512 includes a second nut 528 engaged with the second end 522 of the bolt 514. The second nut 528 operates in a manner similar to the first nut 526, engaging external threads 536 on the second end of the bolt 514. The second nut 528 may extend around both the first half 516 and the second half 518, providing axial retention in a direction opposite the first nut 526. This dual-nut arrangement may be beneficial, for instance, where high retention forces are needed to mitigate movement due to vibration or cyclic loading.

In the embodiment of FIG. 8, the portion 500 includes a biasing member 534 disposed beneath the protrusion 510. The biasing member 534 is located between the protrusion 510 and the fastener 512 within the receptacle 524. The biasing member 534 is configured to urge the protrusion 510 against the fastener 512. For example, the biasing member 534 may be a spring, such as a metallic coil, a disc spring, or another elastic component, disposed within the receptacle 524 or surrounding a portion of the protrusion 510. In alternative embodiments, the biasing member 534 may include a plurality of spring elements arranged in parallel, in series, or in a combined arrangement, depending on the desired force-displacement characteristics and available space within the portion 500. The tile 508, via the protrusion 510, is thus held in place by the interaction between the protrusion 510 and the receptacle 524 of the bolt 514, with the engagement force further influenced by the action of the biasing member 534.

The biasing member 534 is optionally compressible to allow movement of the protrusion 510 within the receptacle 524 during thermal expansion of the tile 508 or the bolt 514. By urging the protrusion 510 outward, the biasing member 534 may improve the likelihood of maintaining contact between the protrusion 510 and the fastener 512 throughout a range of thermal and mechanical conditions experienced during engine operation. For example, when the tile 508 expands due to elevated combustion temperatures, the biasing member 534 can compress, accommodating the change in dimension and helping to reduce the opportunity for excessive mechanical loading or disengagement between the tile 508 and the sheet 502.

The portion 500 of FIG. 8 is designed such that the sheet 502 is metallic, which may be advantageous for structural support and thermal conductivity. The use of a metallic liner, in combination with a ceramic matrix composite tile 508 and a compliant biasing member 534, provides a combustor assembly that may accommodate the different coefficients of thermal expansion of the components while retaining desirable structural and thermal performance.

As depicted, the biasing member 534 may extend from the protrusion 510 to either side of the receptacle 524, optionally contacting portions of both the tile 508 and an interior of the fastener 512. In certain implementations, the biasing member 534 is located substantially between the base of the protrusion 510 and inner walls of the receptacle 524. In yet other variants, the biasing member 534 may be disposed to bias the protrusion 510 strictly in an outward radial direction, or may be configured to provide a bias force in an axial direction parallel to the bolt 514.

An example arrangement may include the biasing member 534 as a wave spring or multi-turn coil spring, disposed circumferentially around the protrusion 510 and compressed between the tile 508 and a seat formed in the receptacle 524. Alternatively, the biasing member 534 may comprise a stack of disc springs for higher spring rates or for accommodating limited axial stroke.

During operation, the interplay between the metallic sheet 502, the tile 508 (formed of a ceramic matrix composite or other suitable high-temperature material), the protrusion 510, the bolt 514 with its first and second halves 516, 518, and the biasing member 534 may provide a mechanically and thermally compliant attachment scheme for combustor tiles in a gas turbine engine configuration. Assembly and maintenance may involve removing the first and second nuts 526, 528 and withdrawing the fastener 512, whereupon the biasing member 534 may be accessed, replaced, or adjusted as needed.

Figure 9:
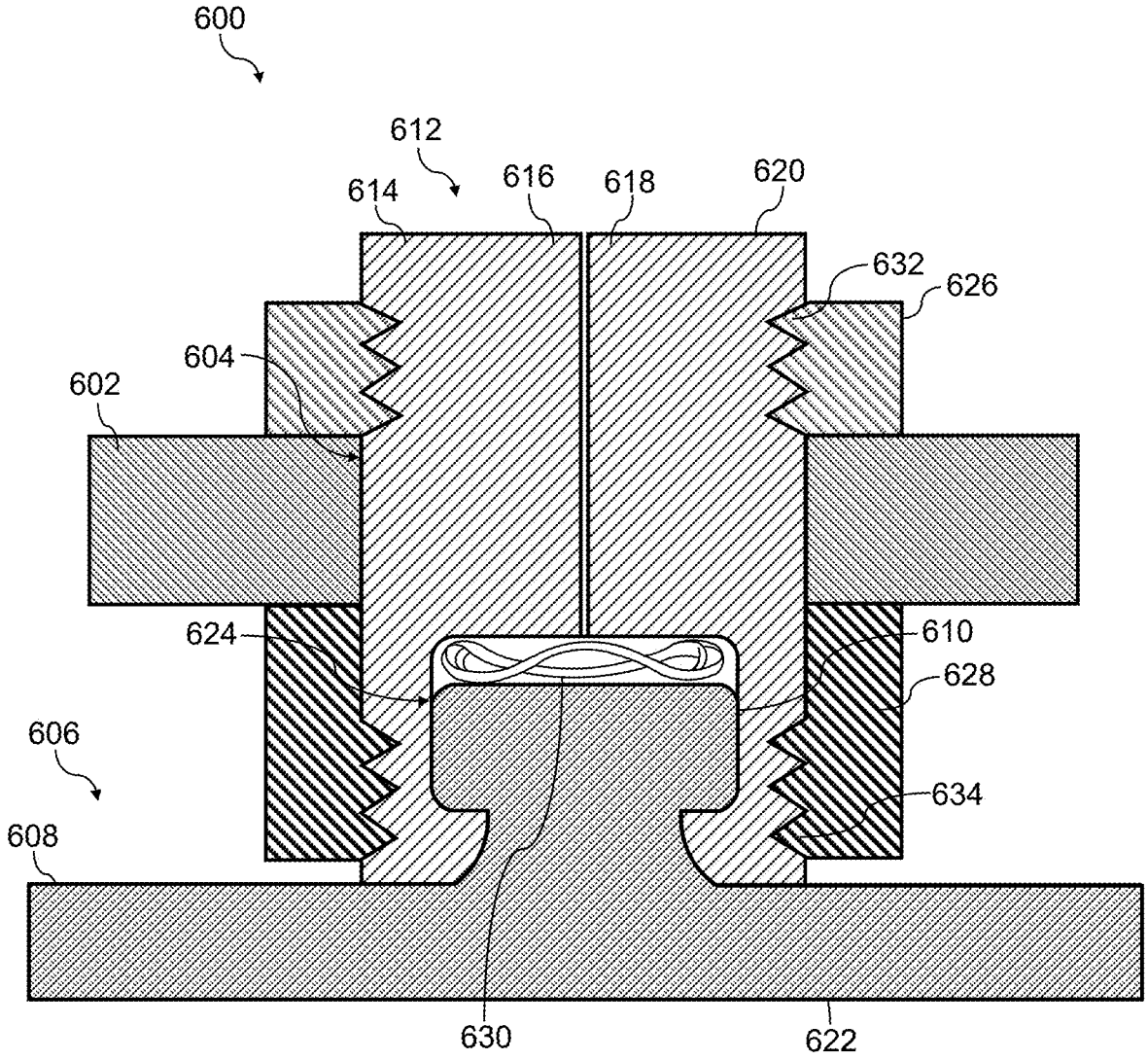
FIG. 9 is a magnified view of the combustion section including another fastener securing a tile to a liner and another biasing member, in accordance with an exemplary embodiment of the present disclosure.

Referring now to FIG. 9, a schematic magnified view of a portion 600 is provided in accordance with another exemplary aspect of the present disclosure. The exemplary portion 600 of FIG. 9 may be configured in substantially the same manner as the exemplary structures of FIGS. 3-8, and accordingly, the same or similar numbers may refer to the same or similar parts. For example, the exemplary portion 600 of FIG. 9 generally includes a sheet 602, a tile liner 606 including a tile 608, a fastener 612 securing a protrusion 610 of the tile 608 to the sheet 602, and a biasing member 630 disposed adjacent to the protrusion 610. However, for the embodiment of FIG. 9, the biasing member 630 is configured to urge the protrusion 610 inward, toward the sheet 602, rather than outward or away from the liner, as described in other embodiments.

The portion 600 includes the sheet 602, which is metallic and defines a sheet opening 604. The sheet 602 serves as a support structure to which the tile liner 606 is attached. The sheet opening 604 extends through the sheet 602, providing a passage for the fastener 612 to extend between a first side and a second side of the sheet 602. The use of a metallic liner is beneficial for structural support and compatibility with other engine components, but is not required for all embodiments.

The tile liner 606 includes at least one tile 608. The tile 608 may be fabricated from a ceramic matrix composite or another high-temperature material suitable for a combustion environment. The tile 608 is arranged against the second side of the sheet 602 and includes a protrusion 610 extending therefrom. The protrusion 610 is received by the fastener 612 to secure the tile 608 to the sheet 602. In other embodiments, multiple tiles may be included, each with its own protrusion and corresponding fastener.

In the embodiment of FIG. 9, the fastener 612 includes a bolt 614 with a first half 616 and a second half 618. The bolt 614 extends through the sheet opening 604, such that both halves pass from a first end 620 to an opposing second end 622. The fastener 612 further includes a first nut 626 disposed at the first end 620 of the bolt 614 and a second nut 628 disposed at the second end 622 of the bolt. The first nut 626 includes threads 632 that engage the exterior of the first and second halves 616, 618 of the bolt 614 and secures the fastener 612 to the sheet 602 from the first side. Similarly, the second nut 628 includes threads 634 that provide additional axial retention. This arrangement allows the fastener 612 to secure the tile 608 from both the first side and the opposing second side of the sheet 602.

The protrusion 610 of the tile 608 extends into a receptacle 624 defined between the first half 616 and the second half 618 of the bolt 614 at the second end 622. The receptacle 624 surrounds at least a portion of the protrusion 610 and retains it such that the tile 608 is held in place against the sheet 602. This configuration allows the bolt halves 614, 616 to move away from each other should thermal expansion occur, for example, when the tile 608 and protrusion 610 are formed from a material with a higher coefficient of thermal expansion than the metallic bolt or liner. In other embodiments, the shape or dimension of the receptacle may be modified to suit different protrusion geometries.

The portion 600 of FIG. 9 also includes the biasing member 630. The biasing member 630 is disposed within the receptacle 624, positioned between an inner surface of the receptacle and the protrusion 610, contacting both components. In this embodiment, the biasing member 630 is configured to urge the protrusion 610 in a direction away from the sheet 602. For example, the biasing member 630 may take the form of a coil spring, a disc spring, or a stack of springs arranged to provide a compressive force toward the sheet 602. Alternative spring types, including wave springs, leaf springs, or combinations thereof, may also be used. The selection of spring type may be based on space, operational loads, or desired compliance. The biasing member 630 is configured such that it is compressible to allow inward movement of the protrusion 610 when the tile 608 expands or contracts during changes in operational temperature.

As shown in FIG. 9, the biasing member 630 is disposed above the protrusion 610, occupying a portion of the volume between the protrusion and the walls of the receptacle 624. In this orientation, the biasing member 630 is positioned to oppose outward movement of the protrusion, causing the protrusion to be urged inward toward the metallic sheet 602. This configuration may assist in maintaining the engagement of the tile 608 with the sheet 602 during thermal cycling, and may improve the likelihood of reducing the risk of disengagement or excessive mechanical loading on the protrusion 610.

In alternative embodiments, the biasing member 630 may be arranged in series or in parallel with other springs to adjust the total force-displacement characteristics of the assembly. For example, where additional compliance is needed, a stack of disc springs in series may be selected to distribute the load more evenly. Conversely, a parallel stack could be used if a higher spring force is desired in a compact space. The use of multiple springs is optional and dependent upon specific application requirements.

In some examples, the biasing member 630 is made of metallic alloys capable of maintaining elasticity and integrity across a wide temperature range experienced in gas turbine engines. In other embodiments, the biasing member may be fabricated from ceramics or composite materials, depending on compatibility with adjacent combustor components.

The embodiment depicted in FIG. 9 supports configurations where at least one tile 608 of the tile liner 606 is formed of a ceramic matrix composite, and the sheet 602 is metal. The protrusion 610 may also be formed of ceramic matrix composite, with the fastener halves 616, 618 providing the ability to move apart upon thermal expansion of the protrusion. Ability of the biasing member 630 to urge the protrusion 610 away from the sheet 602 further accommodates the differences in coefficient of thermal expansion, helping to maintain a secure fit during all phases of engine operation.

For instance, in certain operating scenarios where the tile 608 undergoes repeated thermal cycling, the biasing member 630 may compress or relax according to thermal loads, maintaining inward pressure on the protrusion 610 so that the tile remains positioned relative to the sheet 602. In an alternative embodiment, the orientation of the biasing force may be modified or reoriented to suit specific combustor designs.

Figure 10D:
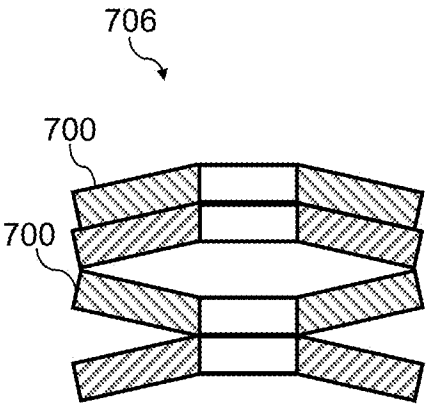
FIG. 10D is a side view of another exemplary biasing member as a plurality of disc springs arranged in a combined arrangement, in accordance with an exemplary embodiment of the present disclosure.
Figure 10C:
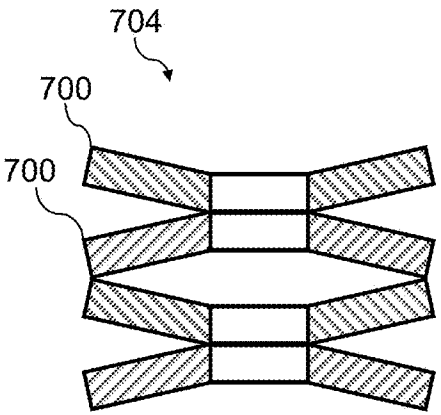
FIG. 10C is a side view of another exemplary biasing member as a plurality of disc springs arranged in a series arrangement, in accordance with an exemplary embodiment of the present disclosure.
Figure 10B:
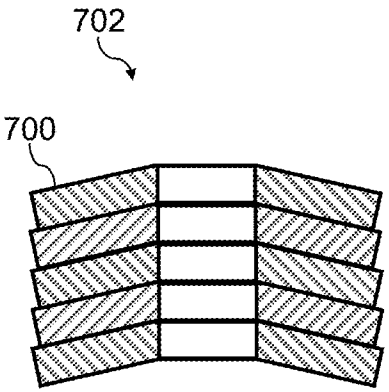
FIG. 10B is a side view of another exemplary biasing member as a plurality of disc springs arranged in a parallel arrangement, in accordance with an exemplary embodiment of the present disclosure.
Figure 10A:
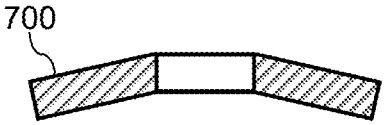
FIG. 10A is a side view of an exemplary biasing member as a disc spring, in accordance with an exemplary embodiment of the present disclosure.

Referring now to FIGS. 10A-10D, schematic views of exemplary biasing member arrangements suitable for use in a combustion sections is provided in accordance with another exemplary aspect of the present disclosure. FIG. 10A illustrates a single disc spring. FIG. 10B illustrates a plurality of disc springs in a parallel arrangement. FIG. 10C illustrates a plurality of disc springs in a series arrangement. FIG. 10D illustrates a plurality of disc springs in a combined arrangement.

In FIG. 10A, a biasing member is depicted as a single disc spring 700. The disc spring 700 is shown in profile view, having a generally conical or washer-like geometry. In one embodiment, the disc spring 700 may be formed of a metallic material compatible with the temperature and environmental conditions experienced in a gas turbine combustor. The single disc spring 700 may be positioned beneath, adjacent, or surrounding a tile protrusion, such as the protrusion 510, to urge the protrusion outward or inward, depending on the particular assembly requirements. For instance, when used as described in relation to FIG. 8 or 9, the disc spring 700 may urge the protrusion against a fastener during thermal expansion of the tile and the fastener. The disc spring 700 is optionally sized to fit within a receptacle or cavity formed in a fastener, such as receptacle 524 or 624.

FIG. 10B shows a parallel arrangement 702, in which a plurality of disc springs 700 are arranged in parallel. In this "parallel" configuration, several disc springs 700 are stacked such that the faces of each spring are aligned and adjacent, with the conical axes oriented in the same direction. The parallel arrangement 702 may be used, for example, where higher spring force is required for a given deflection, as the load capacity of the springs is additive. This feature may be beneficial when accommodating higher loads or when a more compact spring assembly is desirable. The parallel arrangement 702 may be installed beneath or around the tile protrusion in a similar manner as a single disc spring, and the number of springs may be selected to achieve a specific force-deflection characteristic. For example, in an engine design requiring increased clamp force to retain a tile, the plurality of disc springs 700 arranged in parallel may be used in place of or in addition to a single disc spring.

FIG. 10C depicts a series arrangement 704, which includes a plurality of disc springs 700 arranged in series. In this "series" configuration, individual disc springs 700 are nested such that the conical faces oppose each other. This series arrangement 704 provides a greater overall deflection range for the biasing member, as each spring's displacement is cumulative, but it results in lower total force for a given displacement in comparison to a parallel arrangement 702. A biasing member arranged in series may be selected where greater travel or deflection is required to accommodate relative movement between a tile and a liner, for instance due to increased thermal expansion. As an example, in a combustor where tiles undergo significant dimensional change during operation, a series arrangement 704 may be used to provide the necessary compliance without imposing excessive force on the tile or fastener components.

FIG. 10D shows a combined arrangement 706, which includes a plurality of disc springs 700 arranged in series and parallel. In this "combined" configuration, disc springs 700 are grouped into parallel arrangements, and each parallel group is then arranged in series with other groups. This combined arrangement 706 allows for further tailoring of the force-displacement response, enabling the design of the biasing member to achieve a desired balance of force and available deflection. For example, for installations needing both a higher load capacity and greater compliance, the combined arrangement 706 provides flexibility in achieving system requirements.

The use of disc springs 700 as biasing members, whether individually, in the parallel arrangement 702, in the series arrangement 704, or in the combined arrangement 706, offers adaptability for a range of combustor design parameters. The disc springs 700 may be metallic and may include suitable surface treatments, such as coatings for oxidation or corrosion resistance appropriate for high-temperature combustor service. In some embodiments, the diameter, thickness, and cone angle of each disc spring 700 may be selected according to the required load and deflection. For example, disc springs thicker or of wider diameter may be incorporated for higher forces, while thinner or narrower disc springs may be selected for applications requiring more deflection and gentler biasing forces.

The arrangements shown in FIG. 10 provide examples of how biasing members can be selected to meet diverse combustor needs. For instance, where higher retention force is needed with limited movement, a parallel arrangement 702 may be beneficial. Where greater movement is desired but with less force, a series arrangement 704 may be employed. The combined arrangement 706 allows further adjustment, such as achieving moderate loads with moderate stroke. These configurations may be used in combustors having liner and tile assemblies as described in the present disclosure, optionally disposed between a tile protrusion and a fastener receptacle.

In alternative embodiments, the number of disc springs in a stack may be varied beyond what is shown, and additional configurations such as alternating series and parallel stacks may be utilized. While the disc springs 700 are depicted as individual metallic members, composite or ceramic disc springs may also be used where required by application constraints. The position of the biasing members relative to the protrusion, fastener, and liner may also vary. For example, the biasing member could be placed beneath the protrusion, surrounding the protrusion, or between the liner and the tile body, depending on assembly arrangement. In some cases, multiple sets of springs may be incorporated at different positions along a tile-to-liner joint.

Further aspects are provided by the subject matter of the following clauses:

A liner for a combustion section of for a gas turbine engine includes a sheet defining a sheet opening, a tile liner coupled to the sheet and including a plurality of tiles, each tile of the plurality of tiles including a protrusion, and a fastener for securing each tile of the plurality of tiles to the sheet, the fastener including a bolt including a first half and a second half, the bolt defining a first end and a second end opposite the first end, the second end of the bolt defining a receptacle between the first half and the second half with the protrusion positioned therein, wherein at least a portion of the first half and the second half of the bolt extend though the sheet opening, and a nut engaged with the first end of the bolt securing the first half of the bolt to the second half of the bolt.

The liner of any of the preceding clauses, further including a biasing member adjacent the protrusion of each tile of the plurality of tiles.

The liner of any of the preceding clauses, wherein the biasing member is a spring.

The liner of any of the preceding clauses, wherein the biasing member includes a plurality of springs including the spring.

The liner of any of the preceding clauses, wherein the plurality of springs are disc springs arranged in series.

The liner of any of the preceding clauses, wherein the plurality of springs are disc springs arranged in parallel.

The liner of any of the preceding clauses, wherein the biasing member is disposed radially inward of the protrusion.

The liner of any of the preceding clauses, wherein the biasing member is configured to urge the protrusion against the fastener during thermal expansion of the tile and the fastener.

The liner of any of the preceding clauses, further including a retaining ring disposed about the second end of the bolt.

The liner of any of the preceding clauses, wherein the retaining ring secures the first half of the bolt and the second half of the bolt relative to each other.

The liner of any of the preceding clauses, wherein the first half of the bolt defines a first retaining ring slot and the second half of the bolt defines a second retaining ring slot, and the retaining ring is disposed in the first retaining ring slot and disposed in the second retaining ring slot.

The liner of any of the preceding clauses, wherein the first end of the bolt is disposed on a first side of the sheet and the second end of the bolt is disposed on an opposing second side of the sheet.

The liner of any of the preceding clauses, wherein at least one tile of the plurality of tiles is formed of a ceramic matrix composite (CMC).

The liner of any of the preceding clauses, wherein the protrusion is formed of CMC and the first half of the bolt and the second half of the bolt are configured to move away from each other upon thermal expansion of the protrusion.

The liner of any of the preceding clauses, wherein the sheet is metal.

The liner of any of the preceding clauses, wherein the first half of the bolt defines a first bolt outer surface and the second half of the bolt defines a second bolt outer surface, and the nut extends around the first bolt outer surface and the second bolt outer surface.

The liner of any of the preceding clauses, wherein the tile defines a base, and the protrusion includes a head and a shaft, the shaft extending from the base to the head, wherein the head defines a head width and the shaft defines a shaft width, wherein the head width is greater than the shaft width.

The liner of any of the preceding clauses, wherein the receptacle defines a head cavity and a shaft cavity, the head cavity defining a head cavity width based on the head width of the head of the protrusion, and the shaft cavity defining a shaft cavity width based on the shaft width of the shaft of the protrusion.

The liner of any of the preceding clauses, wherein the first end of the bolt defines a first end width, the second end of the bolt defines a second end width, and the first end width is a different width than the second end width.

The liner of any of the preceding clauses, wherein the first end of the bolt defines a first end width, the second end of the bolt defines a second end width, and the first end width is a same width as the second end width.

A gas turbine engine includes a turbomachine, the turbomachine includes a combustion section, and the combustion section includes a liner including a sheet defining a sheet opening, a tile liner coupled to the sheet and including a plurality of tiles, each tile of the plurality of tiles including a protrusion, and a fastener for securing each tile of the plurality of tiles to the sheet, the fastener including a bolt including a first half and a second half, the bolt defining a first end and a second end opposite the first end, the second end of the bolt defining a receptacle between the first half and the second half with the protrusion positioned therein, wherein at least a portion of the first half and the second half of the bolt extend though the sheet opening, and a nut engaged with the first end of the bolt securing the first half of the bolt to the second half of the bolt.

The gas turbine engine of any of the preceding clauses, further including a biasing member adjacent the protrusion of each tile of the plurality of tiles.

The gas turbine engine of any of the preceding clauses, wherein the biasing member is a spring.

The gas turbine engine of any of the preceding clauses, wherein the biasing member includes a plurality of springs including the spring.

The gas turbine engine of any of the preceding clauses, wherein the plurality of springs are disc springs arranged in series.

The gas turbine engine of any of the preceding clauses, wherein the plurality of springs are disc springs arranged in parallel.

The gas turbine engine of any of the preceding clauses, wherein the biasing member is disposed radially inward of the protrusion.

The gas turbine engine of any of the preceding clauses, wherein the biasing member is configured to urge the protrusion against the fastener during thermal expansion of the tile and the fastener.

The gas turbine engine of any of the preceding clauses, further including a retaining ring disposed about the second end of the bolt.

The gas turbine engine of any of the preceding clauses, wherein the retaining ring secures the first half of the bolt and the second half of the bolt relative to each other.

The gas turbine engine of any of the preceding clauses, wherein the first half of the bolt defines a first retaining ring slot and the second half of the bolt defines a second retaining ring slot, and the retaining ring is disposed in the first retaining ring slot and disposed in the second retaining ring slot.

The gas turbine engine of any of the preceding clauses, wherein the first end of the bolt is disposed on a first side of the sheet and the second end of the bolt is disposed on an opposing second side of the sheet.

The gas turbine engine of any of the preceding clauses, wherein at least one tile of the plurality of tiles is formed of a ceramic matrix composite (CMC).

The gas turbine engine of any of the preceding clauses, wherein the protrusion is formed of CMC and the first half of the bolt and the second half of the bolt are configured to move away from each other upon thermal expansion of the protrusion.

The gas turbine engine of any of the preceding clauses, wherein the sheet is metal.

The gas turbine engine of any of the preceding clauses, wherein the first half of the bolt defines a first bolt outer surface and the second half of the bolt defines a second bolt outer surface, and the nut extends around the first bolt outer surface and the second bolt outer surface.

The gas turbine engine of any of the preceding clauses, wherein the tile defines a base, and the protrusion includes a head and a shaft, the shaft extending from the base to the head, wherein the head defines a head width and the shaft defines a shaft width, wherein the head width is greater than the shaft width.

The gas turbine engine of any of the preceding clauses, wherein the receptacle defines a head cavity and a shaft cavity, the head cavity defining a head cavity width based on the head width of the head of the protrusion, and the shaft cavity defining a shaft cavity width based on the shaft width of the shaft of the protrusion.

The gas turbine engine of any of the preceding clauses, wherein the first end of the bolt defines a first end width, the second end of the bolt defines a second end width, and the first end width is a different width than the second end width.

The gas turbine engine of any of the preceding clauses, wherein the first end of the bolt defines a first end width, the second end of the bolt defines a second end width, and the first end width is a same width as the second end width.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

We claim:

1. A liner for a combustion section of a gas turbine engine comprising:

a sheet defining a sheet opening;

a tile liner coupled to the sheet and comprising a plurality of tiles, each tile of the plurality of tiles comprising a protrusion; and a fastener for securing each tile of the plurality of tiles to the sheet, the fastener comprising:

a bolt including a first half and a second half, the bolt defining a first end and a second end opposite the first end, the second end of the bolt defining a receptacle between the first half and the second half with the protrusion positioned therein, wherein at least a portion of the first half and the second half of the bolt extend though the sheet opening; and a nut engaged with the first end of the bolt securing the first half of the bolt to the second half of the bolt.

2. The liner of claim 1, further comprising a biasing member adjacent the protrusion of each tile of the plurality of tiles.

3. The liner of claim 2, wherein the biasing member is a spring.

4. The liner of claim 3, wherein the biasing member comprises a plurality of springs including the spring.

5. The liner of claim 4, wherein the plurality of springs are disc springs arranged in series.

6. The liner of claim 4, wherein the plurality of springs are disc springs arranged in parallel.

7. The liner of claim 2, wherein the biasing member is disposed radially inward of the protrusion.

8. The liner of claim 2, wherein the biasing member is configured to urge the protrusion against the fastener during thermal expansion of the tile and the fastener.

9. The liner of claim 1, further comprising a retaining ring disposed about the second end of the bolt.

10. The liner of claim 9, wherein the retaining ring secures the first half of the bolt and the second half of the bolt relative to each other.

11. The liner of claim 9, wherein the first half of the bolt defines a first retaining ring slot and the second half of the bolt defines a second retaining ring slot, and the retaining ring is disposed in the first retaining ring slot and disposed in the second retaining ring slot.

12. The liner of claim 1, wherein the first end of the bolt is disposed on a first side of the sheet and the second end of the bolt is disposed on an opposing second side of the sheet.

13. The liner of claim 1, wherein at least one tile of the plurality of tiles is formed of a ceramic matrix composite (CMC).

14. The liner of claim 13, wherein the protrusion is formed of CMC and the first half of the bolt and the second half of the bolt are configured to move away from each other upon thermal expansion of the protrusion.

15. The liner of claim 1, wherein the sheet is metal.

16. The liner of claim 1, wherein the first half of the bolt defines a first bolt outer surface and the second half of the bolt defines a second bolt outer surface, and the nut extends around the first bolt outer surface and the second bolt outer surface.

17. The liner of claim 1, wherein the tile defines a base, and the protrusion comprises a head and a shaft, the shaft extending from the base to the head, wherein the head defines a head width and the shaft defines a shaft width, wherein the head width is greater than the shaft width.

18. The liner of claim 17, wherein the receptacle defines a head cavity and a shaft cavity, the head cavity defining a head cavity width based on the head width of the head of the protrusion, and the shaft cavity defining a shaft cavity width based on the shaft width of the shaft of the protrusion.

19. The liner of claim 1, wherein the first end of the bolt defines a first end width, the second end of the bolt defines a second end width, and the first end width is a different width than the second end width.

20. The liner of claim 1, wherein the first end of the bolt defines a first end width, the second end of the bolt defines a second end width, and the first end width is a same width as the second end width.

* * * * *